US007429447B2

(12) United States Patent
Ohzeki

(10) Patent No.: US 7,429,447 B2
(45) Date of Patent: Sep. 30, 2008

(54) PHOTOTHERMOGRAPHIC MATERIAL AND IMAGE FORMING METHOD

(75) Inventor: Katsuhisa Ohzeki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/340,478

(22) Filed: Jan. 27, 2006

(65) Prior Publication Data

US 2006/0172235 A1 Aug. 3, 2006

(30) Foreign Application Priority Data

Feb. 2, 2005 (JP) ..... 2005-026327
Feb. 2, 2005 (JP) ..... 2005-026328

(51) Int. Cl.
*G03C 5/16* (2006.01)
*G03C 1/498* (2006.01)

(52) U.S. Cl. ..... 430/350; 430/139; 430/264; 430/531; 430/607; 430/619

(58) Field of Classification Search ..... 430/350, 430/619, 531, 567, 264, 966, 139, 607
See application file for complete search history.

(56) References Cited

U.S. PATENT DOCUMENTS 4,629,684 A * 12/1986 Sato et al. ..... 430/559
5,089,378 A * 2/1992 Ozaki et al. ..... 430/351
6,146,823 A * 11/2000 Katoh ..... 430/619

FOREIGN PATENT DOCUMENTS

JP A 11-295847 10/1999

* cited by examiner

*Primary Examiner*—Thorl Chea
(74) *Attorney, Agent, or Firm*—Margaret A. Burke; Sheldon J. Moss

(57) ABSTRACT

A photothermographic material having, on at least one side of a support, an image forming layer including at least a photosensitive silver halide, a non-photosensitive silver salt of a fatty acid, a reducing agent, and a binder, wherein 1) the photosensitive silver halide has an average silver iodide content of 40 mol % or higher, and 2) the photothermographic material includes a compound represented by the following formula (I) or a salt thereof:

$$R_1—C{=}C—R_1' \qquad \text{Formula (I)}$$

wherein $R_1$ and $R_1'$ each independently represent a hydrogen atom, or a substituted or unsubstituted alkyl group, aryl group, or heterocyclic group, and $R_1$ and $R_1'$ are not simultaneously a hydrogen atom. The invention provides a photothermographic material which exhibits high sensitivity and excellent image storability, and an image forming method.

20 Claims, No Drawings

PHOTOTHERMOGRAPHIC MATERIAL AND IMAGE FORMING METHOD

CROSS-REFERENCE TO RELATED APPLICATION

This application claims priority under 35 USC 119 from Japanese Patent Application Nos. 2005-026327 and 2005-026328, the disclosures of which are incorporated by reference herein.

BACKGROUND OF THE INVENTION

1. Field of the Invention

The present invention relates to a photothermographic material and an image forming method. More specifically, the invention relates to a photothermographic material and an image forming method which exhibit high sensitivity and improved image storage stability.

2. Description of the Related Art

In recent years, in the field of films for medical diagnosis and in the field of films for graphic arts, there has been a strong desire for decreasing the amount of processing liquid waste from the viewpoints of protecting the environment and economy of space. Technology is therefore required for light sensitive photothermographic materials which can be exposed effectively by laser image setters or laser imagers and thermally developed to obtain clear black-toned images of high resolution and sharpness, for use in medical diagnostic applications and for use in photographic technical applications. The light sensitive photothermographic materials do not require liquid processing chemicals and can therefore be supplied to customers as a simpler and environmentally friendly thermal processing system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal image forming systems utilizing organic silver salts are described, for example, in U.S. Pat. Nos. 3,152,904 and 3,457,075, as well as in "Thermally Processed Silver Systems" by D. H. Klosterboer, appearing in "Imaging Processes and Materials", Neblette, 8th edition, edited by J. Sturge, V. Warlworth, and A. Shepp, Chapter 9, pages 279 to 291, 1989. All of the patents, patent publications, and non-patent literature cited in the specification are hereby expressly incorporated by reference herein. In particular, photothermographic materials generally have an image forming layer including a catalytically active amount of a photocatalyst (for example, silver halide), a reducing agent, a reducible silver salt (for example, an organic silver salt), and if necessary, a toner for controlling the color tone of developed silver images, dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region.

Photothermographic materials utilizing an organic silver salt have a great merit of containing all components necessary for image formation in the film in advance and being capable of forming images only by heating. However, on the other hand, photosensitive silver halide remains in the material, and as a result, light scattering and light absorption due to the silver halide grains causes turbidity of the film, whereby the film becomes opaque. In order to avoid the above defects, it is required that a grain size of the photosensitive silver halide grains is minimized and the coating amount thereof is reduced, and therefore, sensitivity of the material is limited. Moreover, after image formation, various chemical components necessary for forming an image remain as is in an unexposed portion, and reaction products remain in the portion where image forming reactions have occurred. These remaining chemical components and reaction products exert adverse influences on storage stability of the image, and thus further improvements in image storage stability are required.

On the other hand, attempts have also been made at applying the photothermographic material as photosensitive material for photographing. The photosensitive material for photographing as used herein means a photosensitive material on which images are recorded by a one-shot exposure through a camera, rather than by writing the image information by a scanning exposure with a laser beam or the like. Conventionally, photosensitive materials for photographing are generally known in the field of wet developing photosensitive materials, and include films for medical use such as direct or indirect radiography films, mammography films and the like, various kinds of photomechanical films used in printing, industrial recording films, films for photographing with general-purpose cameras, and the like. For example, an X-ray photothermographic material coated on both sides using a blue fluorescent intensifying screen described in Japanese Patent No. 3229344, a photothermographic material containing tabular silver iodobromide grains described in Japanese Patent Application Laid-Open (JP-A) No. 59-142539, and a photosensitive material for medical use in which tabular grains that have a high content of silver chloride and have a (100) major face are coated on both sides of a support, which is described in JP-A No. 10-282606, are known. Further, photothermographic materials coated on both sides are also described in JP-A Nos. 2000-227642, 2001-22027, 2001-109101, and 2002-90941.

However, even higher sensitivity is required for recording X-ray images so as to reduce an amount of radioactive radiation exposure with respect to the human body. Attempts to achieve high sensitivity by the conventional methods described above inevitably result in an increase in fog, and therefore, a method to attain high sensitivity while keeping the fog to a minimum is required.

Furthermore, in photothermographic materials comprising high sensitivity emulsions, it is difficult to maintain image storage stability in comparison with photothermographic materials comprising low sensitivity emulsions, and therefore, improvement is demanded.

SUMMARY OF THE INVENTION

A first aspect of the invention is to provide a photothermographic material comprising, on at least one side of a support, an image forming layer comprising at least a photosensitive silver halide, a non-photosensitive silver salt of a fatty acid, a reducing agent, and a binder, wherein the photothermographic material comprises an acetylene compound represented by the following formula (I) or a salt thereof:

$$R_1—C{\equiv}C—R_1' \qquad \text{Formula (I)}$$

wherein $R_1$ and $R_1'$ each independently represent a hydrogen atom, or a substituted or unsubstituted alkyl group, aryl group, or heterocyclic group; and $R_1$ and $R_1'$ are not simultaneously a hydrogen atom.

A second aspect of the invention is to provide an X-ray image forming method using a photothermographic material comprising, on at least one side of a support, an image forming layer comprising at least a photosensitive silver halide, a non-photosensitive silver salt of a fatty acid, a reducing agent, and a binder, wherein the photosensitive silver halide has an average silver iodide content of 40mol % or higher, and the photothermographic material comprises an acetylene compound represented by the following formula (I) or a salt thereof:

$$R_1—C{\equiv}C—R_1' \qquad \text{Formula (I)}$$

wherein $R_1$ and $R_1'$ each independently represent a hydrogen atom, or a substituted or unsubstituted alkyl group, aryl group, or heterocyclic group; and $R_1$ and $R_1'$ are not simultaneously a hydrogen atom, wherein the image forming method comprises:

1) bringing the photothermographic material into contact with a fluorescent intensifying screen;

2) imagewise exposing the photothermographic material with X-rays to record a latent image on the photothermographic material; and 3) thermally developing the photothermographic material to convert the latent image into a visible image by thermal development.

DETAILED DESCRIPTION OF THE INVENTION

An object of the present invention is to provide a photothermographic material and an image forming method which exhibit low fog, high sensitivity, and excellent image storability.

First, a brief description of the present invention will be given.

(Photothermographic Material)

The photothermographic material of the present invention has, on at least one side of a support, an image forming layer containing at least a photosensitive silver halide, a non-photosensitive silver salt of a fatty acid, a reducing agent, and a binder, wherein the photothermographic material contains an acetylene compound represented by the following formula (I) or a salt thereof.

$$R_1—C{\equiv}C—R_1' \qquad \text{Formula (I)}$$

In formula (I), $R_1$ and $R_1'$ each independently represent a hydrogen atom, or a substituted or unsubstituted alkyl group, aryl group, or heterocyclic group, and $R_1$ and $R_1'$ are not simultaneously a hydrogen atom.

Preferably, $R_1'$ represents a hydrogen atom, and $R_1$ represents a substituted or unsubstituted alkyl group, aryl group, or heterocyclic group.

Preferably, the compound represented by the above-described formula (I) or a salt thereof is a compound represented by the following formula (II) or a salt thereof:

Formula (II)

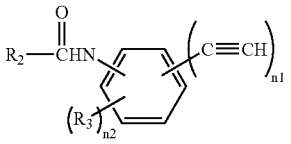

wherein $R_2$ represents a substituted or unsubstituted alkyl group, aryl group, or heterocyclic group; $R_3$ represents a hydrogen atom or a substituent substituting for a hydrogen atom on a benzene ring; n1 represents an integer of from 1 to 5; and n2 represents an integer of from 0 to 4.

More preferably, the compound represented by the above-described formula (II) or a salt thereof is a compound represented by the following formula (III) or a salt thereof:

Formula (III)

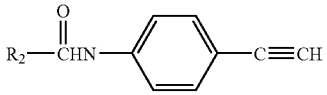

wherein $R_2$ has the same meaning as in formula (II).

One of the preferred types of the photosensitive silver halide is a fine grain-silver halide having a mean grain size of from 0.01 μm to 0.20 μm.

Another preferred type of the photosensitive silver halide is a silver halide in which 50% or more of a total projected area of the silver halide grains is occupied by tabular grains having an aspect ratio of 2 or more, and more preferably, by tabular grains having an aspect ratio of from 5 to 100. Preferably, the tabular grains have a mean equivalent circular diameter of from 0.3 μm to 5.0 μm.

Preferably, an average silver iodide content of the tabular grains is 40 mol % or higher, more preferably 80 mol % or higher, and even more preferably 90 mol % or higher.

Preferably, the photosensitive silver halide is subjected to gold sensitization.

Preferably, the photothermographic material of the invention further comprises a silver iodide complex-forming agent.

Preferably, the photothermographic material of the invention further comprises at least one of development accelerators represented by the following formulae (A-1) or (A-2):

$$Q_1\text{-NHNH-}Q_2 \qquad \text{Formula (A-1)}$$

wherein $Q_1$ represents an aromatic group or a heterocyclic group which bonds to —NHNH-$Q_2$ at a carbon atom; and $Q_2$ represents one selected from a carbamoyl group, an acyl group, an alkoxycarbonyl group, an aryloxycarbonyl group, a sulfonyl group, or a sulfamoyl group; and Formula (A-2)

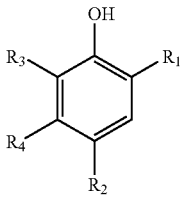

wherein $R_1$ represents one selected from an alkyl group, an acyl group, an acylamino group, a sulfonamide group, an alkoxycarbonyl group, or a carbamoyl group; $R_2$ represents one selected from a hydrogen atom, a halogen atom, an alkyl group, an alkoxy group, an aryloxy group, an alkylthio group, an arylthio group, an acyloxy group, or a carbonic acid ester group; $R_3$ and $R_4$ each independently represent a hydrogen atom or a group substituting for a hydrogen atom on a benzene ring; and $R_3$ and $R_4$ may bond to each other to form a condensed ring.

Preferably, the photothermographic material contains the image forming layer on both sides of the support.

The X-ray image forming method of the present invention comprises: bringing the above-described photothermographic material into contact with a fluorescent intensifying screen; imagewise exposing the photothermographic material with X-rays to record a latent image on the photothermographic material; and thermally developing the photothermographic material to convert the latent image into a visible image by thermal development.

(Image Forming Method)

The image forming method of the present invention is an X-ray image forming method using a photothermographic material comprising, on at least one side of a support, an image forming layer comprising at least a photosensitive silver halide, a non-photosensitive silver salt of a fatty acid, a reducing agent, and a binder, in which the photosensitive silver halide has an average silver iodide content of 40 mol % or higher and the photothermographic material comprises an acetylene compound represented by the following formula (I) or a salt thereof:

$$R_1—C≡C—R_1' \qquad \text{Formula (I)}$$

wherein $R_1$ and $R_1'$ each independently represent a hydrogen atom, or a substituted or unsubstituted alkyl group, aryl group, or heterocyclic group; and $R_1$ and $R_1'$ are not simultaneously a hydrogen atom, wherein the image forming method comprises:

1) bringing the photothermographic material into contact with a fluorescent intensifying screen;

2) imagewise exposing the photothermographic material with X-rays to record a latent image on the photothermographic material; and 3) thermally developing the photothermographic material to convert the latent image into a visible image by thermal development.

(Method for Manufacturing Photothermographic Material)

The method for manufacturing a photothermographic material according to the present invention comprises: preparing a photosensitive silver halide containing a compound represented by the above-described formula (I); preparing a coating solution for an image forming layer by adding the photosensitive silver halide and at least a non-photosensitive silver salt of a fatty acid, a reducing agent, and a binder; and forming an image forming layer by coating the coating solution.

The elements which constitute the present invention are explained in detail in order below.

(Compound Represented by Formula (I))

The photothermographic material of the present invention contains the compound represented by formula (I) or a salt thereof.

$$R_1—C≡C—R_1' \qquad \text{Formula (I)}$$

In formula (I), $R_1$ and $R_1'$ each independently represent a hydrogen atom, or a substituted or unsubstituted alkyl group, aryl group, or heterocyclic group. However $R_1$ and $R_1'$ are not simultaneously a hydrogen atom.

Preferably, $R_1'$ represents a hydrogen atom, and $R_1$ represents a substituted or unsubstituted alkyl group, aryl group, or heterocyclic group. More preferably, the compound represented by the above-described formula (I) or a salt thereof is a compound represented by the following formula (II) or a salt thereof.

Formula (II)

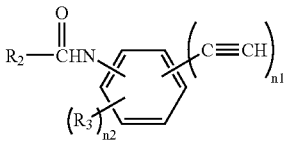

In formula (II), $R_2$ represents a substituted or unsubstituted alkyl group, aryl group, or heterocyclic group, $R_3$ represents a hydrogen atom or a substituent substituting for a hydrogen atom on a benzene ring, n1 represents an integer of from 1 to 5, and n2 represents an integer of from 0 to 4.

Even more preferably, the compound represented by the above-described formula (II) or a salt thereof is a compound represented by the following formula (III) or a salt thereof.

Formula (III)

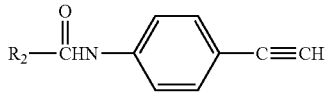

In formula (III), $R_2$ has the same meaning as in formula (II).

As the salt of the compounds represented by the above-described formula (I), (II), or (III), preferred are an alkali metal salt (for example, lithium, sodium, potassium, or the like), an ammonium salt, an alkyl ammonium salt, a phosphonium salt, a metal salt (for example, a salt of zinc, copper, mercury, silver, or the like), and the like.

Formula (I), (II), and (III) are described in detail below.

In formula (I), an alkyl group of $R_1$ may be a linear or branched chain. Examples of the alkyl group include a butyl group, an isobutyl group, a hexyl group, a heptyl group, an octyl group, a dodecyl group, a pentadecyl group, and the like. Examples of the substituent of the substituted alkyl group are an alkoxy group (for example, a methoxy group, or the like), an acetylene group or a salt thereof, an aryloxy group, an acyloxy group, a heterocyclic oxy group, a hydroxy group, a carboxy group or a salt thereof, a formyl group, an acyl group, a substituted or unsubstituted carbamoyl group, an alkoxycarbonyl group, an aryloxycarbonyl group, a mercapto group, an alkylthio group, an arylthio group, a sulfino group or a salt thereof, a sulfo group or a salt thereof, an alkylsulfinyl group, an alkylsulfonyl group, an arylsulfonyl group, a substituted or unsubstituted sulfamoyl group, an alkoxysulfonyl group, an aryloxysulfonyl group, an acylamino group, a substituted or unsubstituted ureido group, an alkoxycarbonylamino group, an aryloxyacrbonylamino group, a nitro group, a nitroso group, a cyano group, a halogen atom, an alkylsulfonylamino group, an arylsulfonylamino group, a substituted or unsubstituted sulfamoylamino group, a substituted or unsubstituted amino group, a cycloalkyl group, an alkenyl group, an aryl group, an aralkyl group, a heterocyclic group, an alkynyl group (for example, an ethynyl group), and the like. These substituents may exist two or more.

As examples of the cycloalkyl group of $R_1$, a cyclopentyl group, a cyclohexyl group, a decahydronaphthyl group, and the like can be described: as examples of the alkenyl group, a propenyl group, an isopropenyl group, a styryl group, and the like can be described: as examples of the alkynyl group, an ethynyl group, a phenylethynyl group, and the like can be described: and as examples of the aralkyl group, a benzyl group a phenetyl group, and the like can be described. These groups may have a substituent explained in the explanation of the alkyl group of $R_1$. Further, the substituents may exist two or more.

As examples of the aryl group of $R_1$, a phenyl group, a naphthyl group, and the like are described. As examples of the substituent of the substituted aryl group, an alkyl group (for example, a methyl group, a dodecyl group, or the like), an alkenyl group, an aryl group, a cycloalkyl group, an aralkyl group, a alkynyl group, a cyano group, a nitro group, a nitroso group, a substituted or unsubstituted amino group, an acylamino group, an acetylene group or a salt thereof, an alkylsulfonylamino group, an arylsulfonylamino group, a substituted or unsubstituted sulfamoylamino group, a hydroxy group, an alkoxy group, an aryloxy group, an alkoxycarbonyl group, an aryloxycarbonyl group, a heterocyclic oxy group, an acyloxy group, a heterocyclic group (a 5- and 6-membered ring are preferred, and among these, a nitrogen containing-heterocycle is more preferred), an alkoxysulfonyl group, an aryloxysulfonyl group, an alkylsulfinyl group, an arylsulfinyl group, an alkylthio group, an arylthio group, a mercapto group, a formyl group, an acyl group, an alkylsulfonyl group, an arylsulfonyl group, a carboxylic acid group or a salt thereof, a sulfonic acid group or a salt thereof, a sulfino group or a salt thereof, a halogen atom (for example, fluorine, bromine, chlorine, or iodine), a substituted or unsubstituted ureido group, a carbamoyl group, a sulfamoyl group, and the like are described.

These substituents may be further substituted. And the substituents as described above may exist two or more.

As the heterocyclic group of $R_1$, a 5- or 6-membered one is preferable. Examples include a furyl group, a thienyl group, benzothienyl group, a pyridyl group, a quinoline group, and the like. These heterocyclic groups may have a substituent similar to that of the above-mentioned substituted aryl group.

$R_2$ in formula (II) are explained in detail below.

In the case where $R_2$ is an alkyl group, the alkyl group may be a linear or branched chain. Examples of the alkyl group include a propyl group, an isopropyl group, a butyl group, an isobutyl group, a tert-butyl group, a pentyl group, a hexyl group, a heptyl group, an isoheptyl group, an octyl group, a nonyl group, a decyl group, a dodecyl group, and a pentadecyl group. Examples of the substituent of the substituted alkyl group include a cycloalkyl group, an alkenyl group, an alkynyl group, an aryl group, an aralkyl group, a heterocyclic group, a halogen atom (for example, fluorine, chlorine, bromine, or iodine), a hydroxy group, an alkoxy group, an aryloxy group, an acyloxy group, a heterocyclic oxy group, a carboxy group or a salt thereof, a formyl group, an acyl group, a substituted or unsubstituted carbamoyl group, an alkoxycarbonyl group, an aryloxycarbonyl group, a cyano group, a mercapto group, an alkylthio group, an arylthio group, a sulfino group or a salt thereof, a sulfo group or a salt thereof, an alkylsulfinyl group, an arylsulfinyl group, an alkylsulfonyl group, an arylsulfonyl group, a substituted or unsubstituted sulfamoyl group, an alkoxysulfonyl group, an aryloxysulfonyl group, a substituted or unsubstituted amino group, an acylamino group, a substituted or unsubstituted ureido group, an alkoxycarbonylamino group, an aryloxycarbonylamino group, an alkylsulfonylamino group, an arylsulfonylamino group, a substituted or unsubstituted sulfamoylamino group, a nitro group, a nitroso group, and the like. These groups may exist two or more and the substituent may be further substituted.

As examples of the cycloalkyl group, a cyclopentyl group, a cyclohexyl group, a decahydronaphthyl group, and the like can be described: and as examples of the alkenyl group, a propenyl group, an isopropenyl group, a styryl group, and the like can be described. These groups may have a substituent explained in the explanation of the alkyl group of $R_1$. The substituents may exist two or more.

As examples of the aryl group, a phenyl group, a naphthyl group, and the like are described. Examples of the substituent of the substituted aryl group include an alkyl group, a cycloalkyl group, an alkenyl group, an alkynyl group, an aryl group, an aralkyl group, a heterocyclic group (a 5- and 6-membered ring are preferred, and among these, a nitrogen containing-heterocycle is more preferred), a halogen atom (for example, fluorine, bromine, chlorine, or iodine), a hydroxy group, an alkoxy group, an aryloxy group, an acyloxy group, a heterocyclic oxy group, a carboxy group or a salt thereof, a formyl group, an acyl group, a substituted or unsubstituted carbamoyl group, an alkoxycarbonyl group, an aryloxycarbonyl group, a cyano group, a mercapto group, an alkylthio group, an arylthio group, a sulfino group or a salt thereof, a sulfo group or a salt thereof, an alkylsulfinyl group, an arylsulfinyl group, an alkylsulfonyl group, an arylsulfonyl group, a substituted or unsubstituted sulfamoyl group, an alkoxysulfonyl group, an aryloxysulfonyl group, a substituted or unsubstituted amino group, an acylamino group, a substituted or unsubstituted ureido group, an alkoxycarbonylamino group, an aryloxycarbonylamino group, an alkylsulfonylamino group, an arylsulfonylamino group, a substituted or unsubstituted sulfamoylamino group, a nitro group, a nitroso group, and the like.

These substituents may be further substituted. And, the substituents as described above may exist two or more.

As examples of the aralkyl group, a benzyl group and a phenetyl group are described. These substituents may have one or more substituents explained in the explanation of the alkyl group or aryl group. The substituent may be further substituted.

As the hetererocyclic group, a 5- or 6-membered one is preferable, for example, a furyl group, a thienyl group, a benzothienyl group, a pyridyl group or quinoline group, and the like are described. These heterocyclic groups may have a substituent similar to the above-described substituted aryl group.

As examples of the alkylene group, a methylene group, an ethylene group, a trimethylene group, a propylene group, and the like are described; as examples of the arylene group, (o-, m-, and p-)phenylene group, (1,4- and the like)naphthylene group, and the like are described; as examples of the cycloalkylene group, a cyclohexylene group and the like are described.

The above divalent residual group may have one or more substituent explained in the explanation of the alkyl group and aryl group. The substituent may be further substituted.

$R_3$ in formula (II) is preferably an alkyl group having 3 or more carbon atoms or a cycloalkyl group, and more preferably an alkyl group having 3 to 10 carbon atoms or a cycloalkyl group.

As $R_2$ in formula (III), an alkyl group (for example, a methyl group, a dodecyl group, or the like), an alkenyl group, an aryl group, a cycloalkyl group, an aralkyl group, an alkynyl group, a cyano group, a nitro group, a nitroso group, a substituted or unsubstituted amino group, an acylamino group, an alkylsulfonylamino group, an arylsulfonylamino group, a substituted or unsubstituted sulfamoylamino group, a hydroxy group, an alkoxy group, an aryloxy group, an alkoxycarbonyl group, an aryloxycarbonyl group, a heterocyclic oxy group, an acyloxy group, a heterocyclic group (a 5- and 6-membered ring are preferred, and among these, a nitrogen containing-heterocycle is more preferred), an alkoxysulfonyl group, an aryloxysulfonyl group, an alkylsulfinyl group, an arylsulfinyl group, an alkylthio group, an arylthio group, a mercapto group, a formyl group, an acyl group, an alkylsulfonyl group, an arylsulfonyl group, a carboxylic acid group or a salt thereof, a sulfonic acid group or a salt thereof, a sulfino group or a salt thereof, a halogen atom (for example, fluorine, bromine, chlorine, or iodine), a substituted or unsubstituted ureido group, a carbamoyl group, a sulfamoyl group, and the like are described.

These substituents may be further substituted. And, the substituents as described above may exist two or more.

n1 is preferably one or two. n2 is preferably zero.

Specific examples of the compound according to the present invention are shown below.
(1)
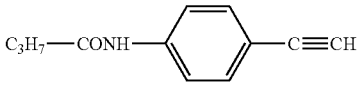
(2)
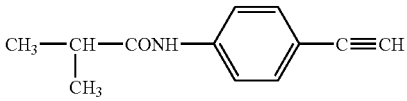
(3)
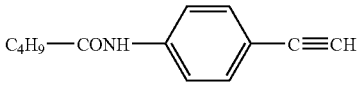
(4)
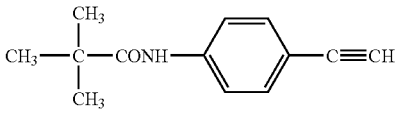
(5)
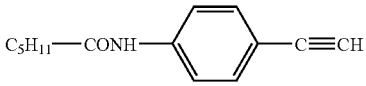
(6)
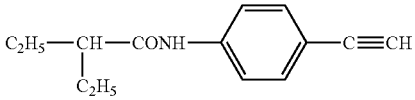
(7)
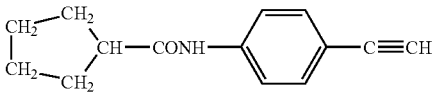
(8)
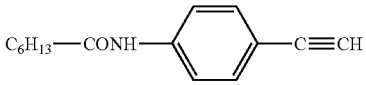
(9)
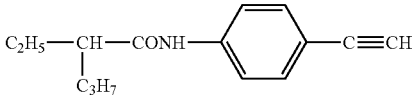
(10)
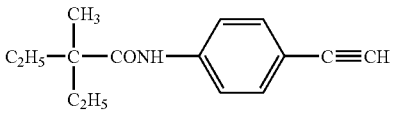
(11)
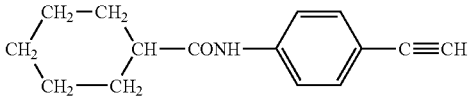
(12)
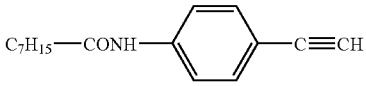
(13)
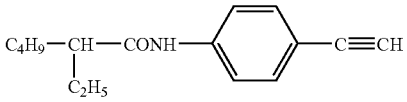
(14)
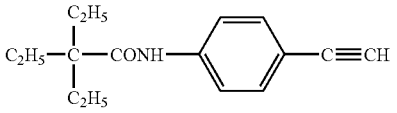
-continued
(15)
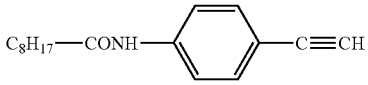
(16)
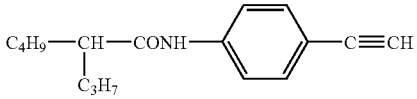
(17)
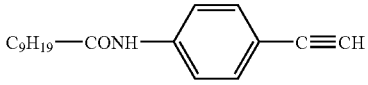
(18)
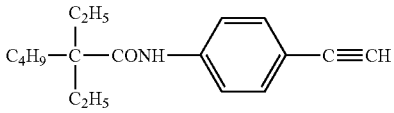
(19)
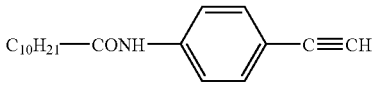
(20)
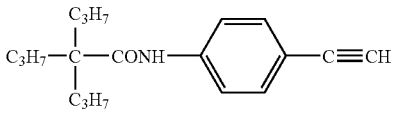
(21)
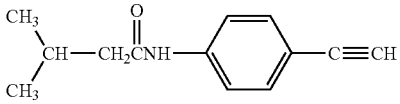
(22)
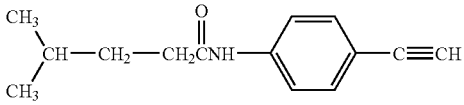
(23)
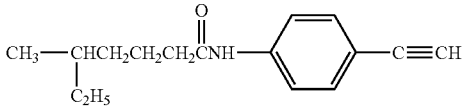
(24)
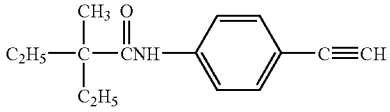
(25)
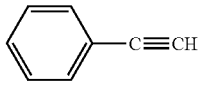
(26)
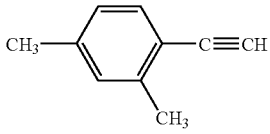
(27)
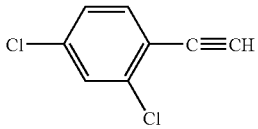
(28)
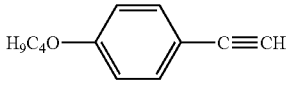

-continued
(29)
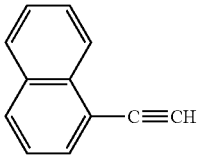
(30)
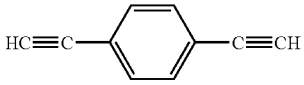
(31)
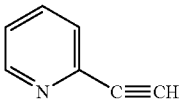
(32)
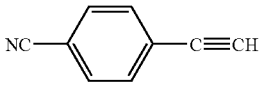
(33)
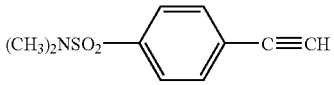
(34)
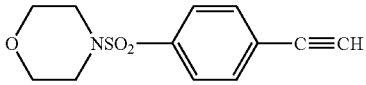
(35)
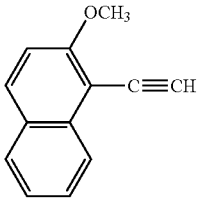
(36)
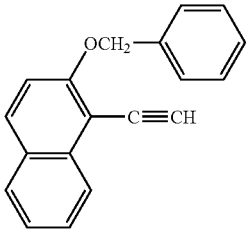
(37)
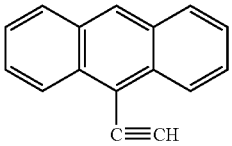
(38)
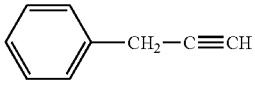
(39)
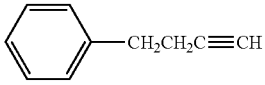
(40)
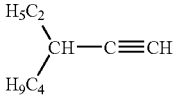
-continued
(41)
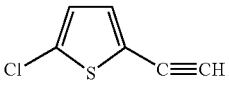
(42)
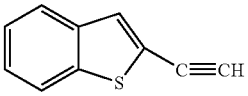
(43)
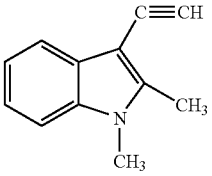
(44)
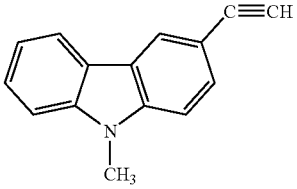
(45)
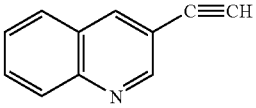
(46)
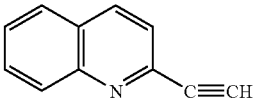
(47)
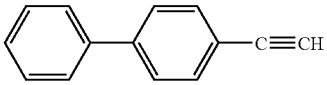
(48)
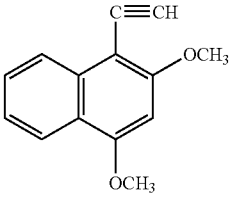
(49)
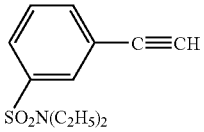
(50)
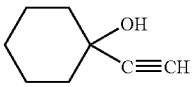
(51)
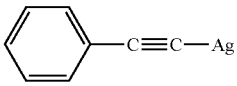
(52)
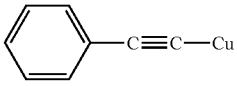

-continued (53)

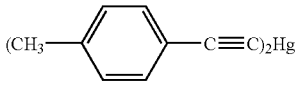

(54)

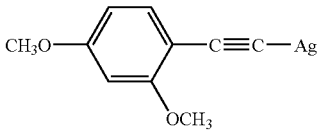

(55)

$(H_{31}C_{15}C{\equiv}C)_2Hg$

The acetylene compound represented by formula (III) according to the present invention can be easily obtained by a condensation reaction of 4-ethynylaniline and an acid chloride of carboxylic acid described below.

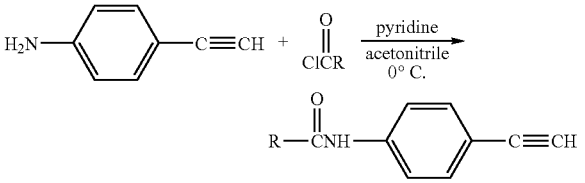

4-ethynylaniline can be synthesized by the method described in Hervetica Chemica Acta., vol. 54, page 2066 (1971).

<Adding Method>

The compound represented by formula (I) according to the invention may be incorporated into a photothermographic material by being added into the coating solution, such as in the form of a solution, an emulsified dispersion, a solid fine particle dispersion, or the like.

As well known emulsified dispersing method, there can be mentioned a method comprising dissolving the compound represented by formula (I) in an oil such as dibutyl phthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsified dispersion is mechanically produced. During the process, for the purpose of controlling viscosity of oil droplet and refractive index, the addition of polymer such as α-methylstyrene oligomer, poly(t-butylacrylamide), or the like is preferable.

As a solid particle dispersing method, there can be mentioned a method comprising dispersing the powder of the compound represented by formula (I) in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

<Layer to be Added>

The compound represented by formula (I) according to the present invention is included in any layer on the side of the support having thereon the image forming layer. Preferably, the compound is used by adding it to the image forming layer or a layer adjacent to the image forming layer, and more preferably by adding it to the image forming layer.

The most preferred method for adding the compound represented by formula (I) according to the present invention is a method of adding the compound after mixing it with photosensitive silver halide, and more preferably, the compound is added at the preparation step of photosensitive silver halide grains, for example, during the time after grain formation and before the chemical sensitization step, at the chemical sensitization step, or during the time after finishing the chemical sensitization and before mixing into a coating solution.

<Addition Amount>

The addition amount of the compound represented by formula (I) according to the present invention is from $1.0\times10^{-8}$ mol to $1.0\times10^{-1}$ mol per 1 mol of photosensitive silver halide, preferably from $1.0\times10^{-7}$ mol to $1.0\times10^{-2}$ mol, and more preferably from $1.0\times10^{-6}$ mol to $1.0\times10^{-2}$ mol.

(Organic Silver Salt)

1) Composition

The organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source supplying silver ions that are reducible by a reducing agent. Such a non-photosensitive organic silver salt is disclosed, for example, in JP-A No. 10-62899 (paragraph Nos. 0048 to 0049), European Patent (EP) No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver capronate, silver myristate, silver palmitate, silver erucate, and mixtures thereof.

In the invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cubic, or potato-like indefinite shaped particles with the major axis to minor axis ratio being lower than 5 are also used preferably. Such organic silver salt particles suffer less from fogging during thermal development compared with long needle-like particles with the major axis to minor axis length ratio of 5 or higher. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)≦1.5.

In the flake shaped particle, a can be regarded as a thickness of a tabular particle having a major plane with b and c being as the sides. a in average is preferably from 0.01 μm to 0.3 μm and, more preferably, from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of the organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more aqueous dispersions of organic silver salts and two or more aqueous dispersions of photosensitive silver salts upon mixing is used preferably for controlling photographic properties.

4) Addition Amount

While the organic silver salt according to the invention can be used in a desired amount, a total amount of coated silver including silver halide is preferably in a range of from 0.1 $g/m^2$ to 5.0 $g/m^2$, more preferably from 0.3 $g/m^2$ to 3.0 $g/m^2$, and even more preferably from 0.5 $g/m^2$ to 2.0 $g/m^2$. In particular, in order to improve image storability, the total amount of coated silver is preferably 1.8 $mg/m^2$ or less, and more preferably 1.6 $mg/m^2$ or less. When a preferable reducing agent in the invention is used, it is possible to obtain a sufficient image density by even such a low amount of silver.

(Reducing Agent)

The photothermographic material of the present invention preferably contains a reducing agent for organic silver salts as a thermal developing agent. The reducing agent for organic silver salts can be any substance (preferably, organic substance) reducing silver ions into metallic silver. Examples of the reducing agent are described in JP-A No. 11-65021 (column Nos. 0043 to 0045) and EP No. 0803764 (p. 7, line 34 to p. 18, line 12).

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

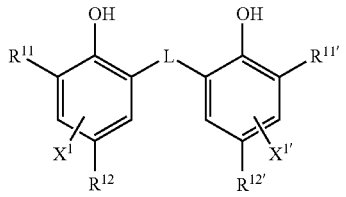

In formula (R), $R^{11}$ and $R^{11'}$ each independently represent an alkyl group having 1 to 20 carbon atoms. $R^{12}$ and $R^{12'}$ each independently represent a hydrogen atom or a group substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group substituting for a hydrogen atom on a benzene ring.

Formula (R) is to be described in detail.

In the following description, when referred to as an alkyl group, it means that the alkyl group contains a cycloalkyl group, as far as it is not mentioned specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group substituting for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, a methyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ preferably is a hydrogen atom.

In the case where $R^{11}$ and $R^{11'}$ are not a tertiary alkyl group, $R^{13}$ preferably is a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more reducing agents in combination, it is preferred to use two or more reducing agents in combination depending on the purpose.

Specific examples of the reducing agents of the invention including the compounds represented by formula (R) according to the invention are shown below, but the invention is not restricted to these.

R-1

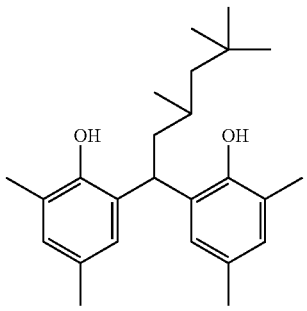

-continued
R-2
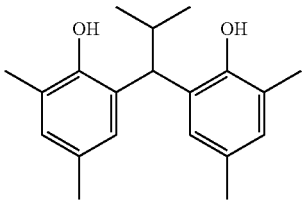
R-3
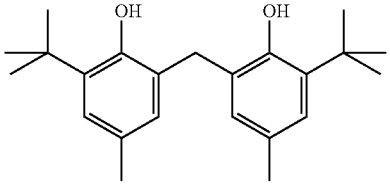
R-4
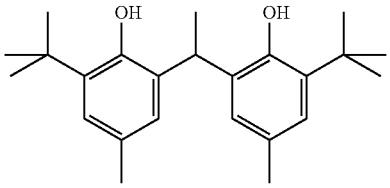
R-5
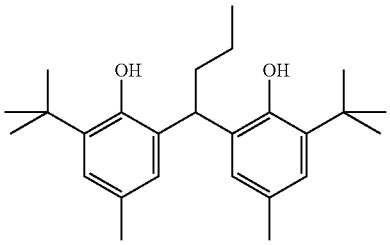
R-6
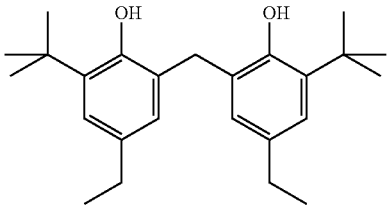
R-7
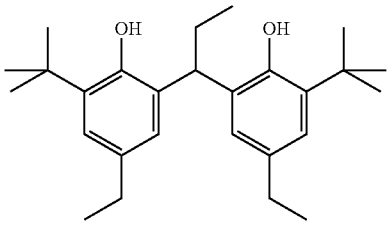
-continued
R-8
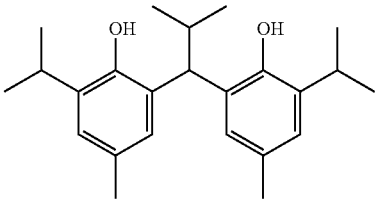
R-9
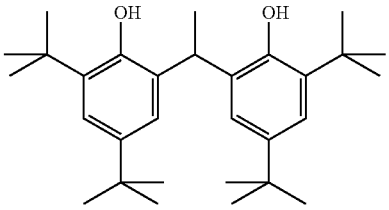
R-10
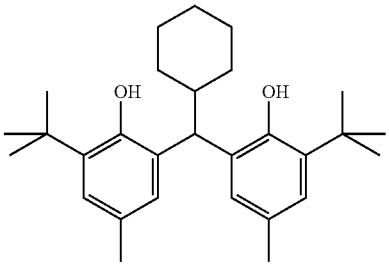
R-11
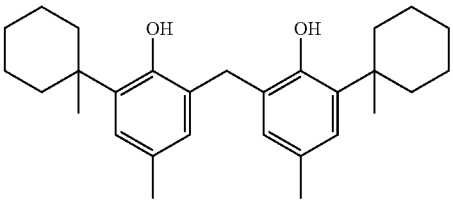
R-12
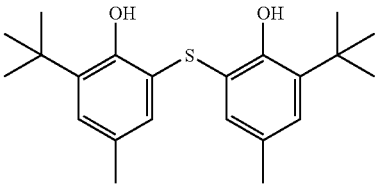
R-13
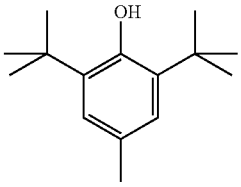
R-14
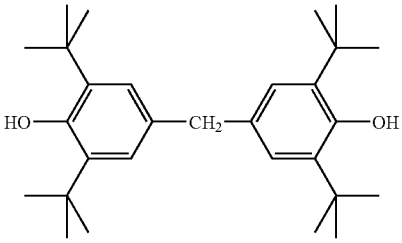

-continued

R-15

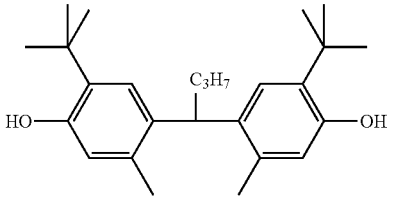

R-16

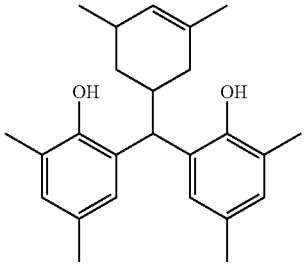

R-17

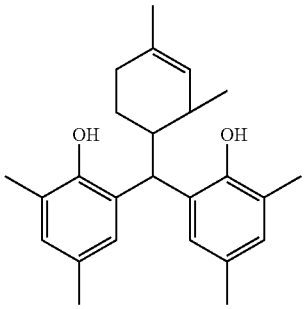

R-18

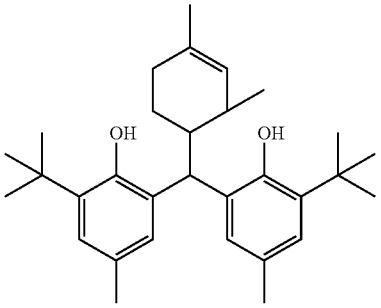

As preferred reducing agents of the invention other than those above, there can be mentioned compounds disclosed in JP-A Nos. 2001-188314, 2001-209145, 2001-350235, and 2002-156727, and EP No. 1278101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into a photothermographic material by being added into the coating solution, such as in the form of a solution, an emulsified dispersion, a solid fine particle dispersion, or the like.

As well known emulsified dispersing method, there can be mentioned a method comprising dissolving the reducing agent in an oil such as dibutyl phthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsified dispersion is mechanically produced. During the process, for the purpose of controlling viscosity of oil droplet and refractive index, the addition of polymer such as α-methylstyrene oligomer, poly(t-butylacrylamide), or the like is preferable.

As a solid particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

(Development Accelerator)

In the photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. Further, phenolic compounds described in JP-A Nos. 2002-311533 and 2002-341484 are also preferable. Naphtholic compounds described in JP-A No. 2003-66558 are particularly preferable. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a solvent having a high boiling point, which is solid at a normal temperature, and an auxiliary solvent having a low boiling point, or to add as a so-called oilless emulsified dispersion not using the solvent having a high boiling point.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) or (A-2).

$Q_1$-NHNH-$Q_2$ Formula (A-1)

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5 to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from one another. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5 or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated hetero ring are more preferred. Further, $Q_2$ is preferably a carbamoyl group and, particularly, a carbamoyl group having a hydrogen atom on the nitrogen atom is particularly preferred.

Formula (A-2)

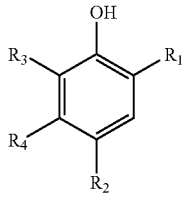

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

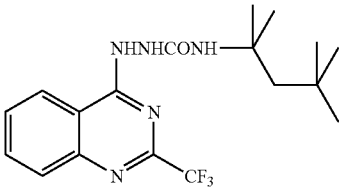

A-2

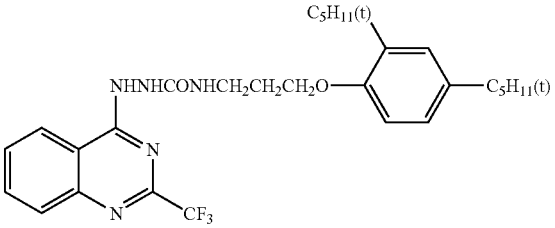

A-3

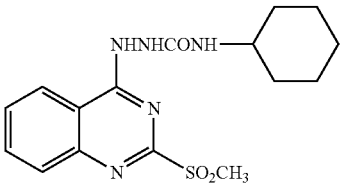

A-4

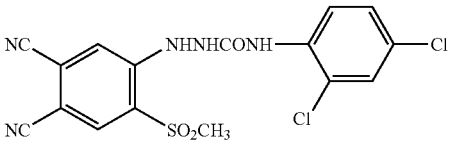

A-5

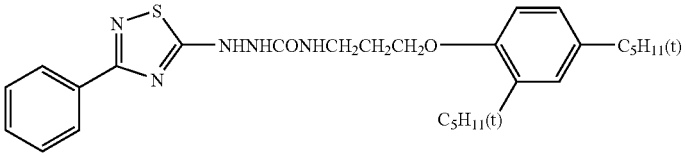

A-6

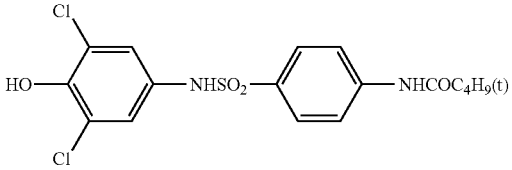

A-7

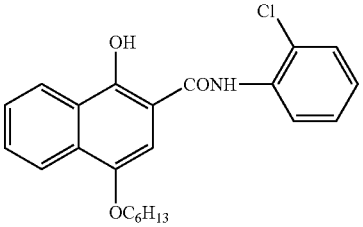

A-8

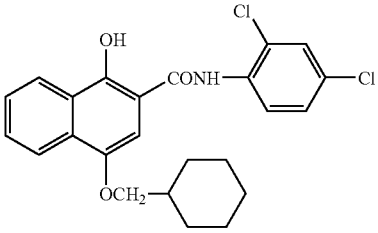

A-9

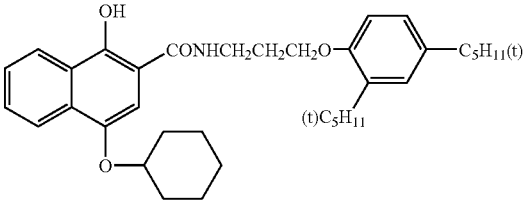

-continued

A-10

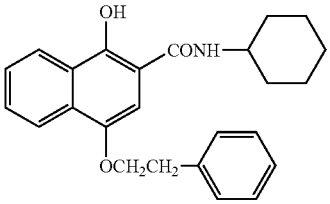

A-11

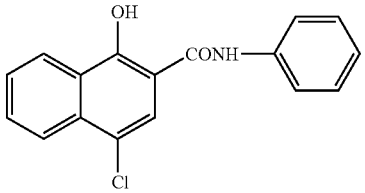

A-12

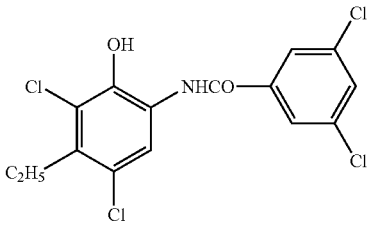

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group reacting with these groups of the reducing agent, and also forming a hydrogen bond therewith.

As a group forming a hydrogen bond with a hydroxy group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having —N(H)— moiety but being blocked in the form of —N(Ra)— (where, Ra represents a substituent other than H)), a urethane group (not having —N(H)— moiety but being blocked in the form of —N(Ra)— (where, Ra represents a substituent other than H)), and a ureido group (not having —N(H)— moiety but being blocked in the form of —N(Ra)— (where, Ra represents a substituent other than H)).

In the invention, particularly preferable as the hydrogen bonding compound is the compound expressed by formula (D) shown below.

Formula (D)

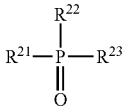

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxy group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others are shown below, but the invention is not limited thereto.

D-1
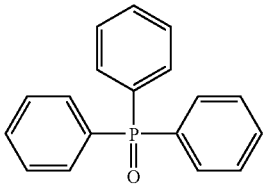
D-2
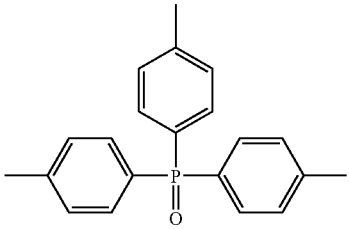
D-3
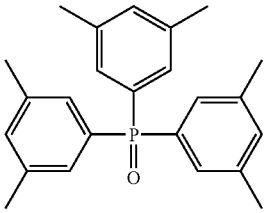
D-4
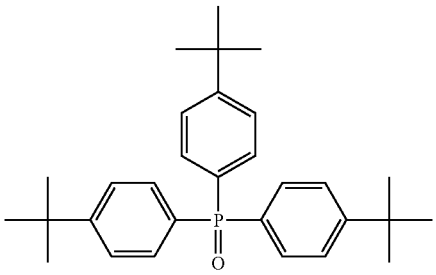
D-5
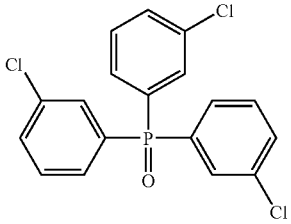
D-6
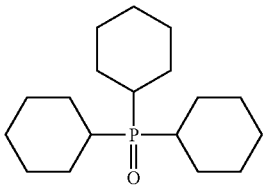
D-7
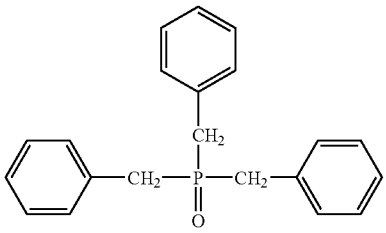
-continued
D-8
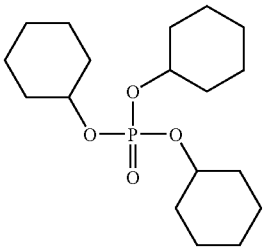
D-9
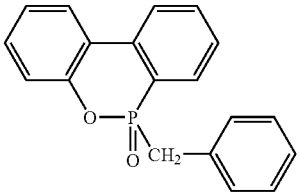
D-10
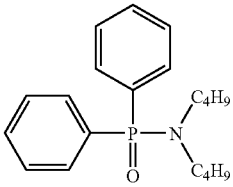
D-11
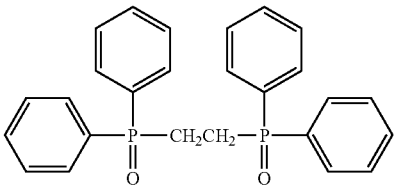
D-12
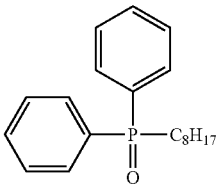
D-13
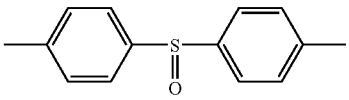
D-14
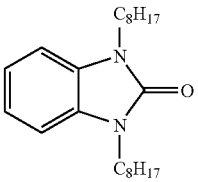
D-15
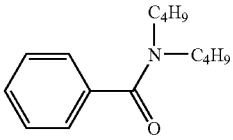
Specific examples of hydrogen bonding compounds other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsified dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxy group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Binder)

Any hydrophobic polymer may be used as the hydrophobic binder for the image forming layer of the invention. Suitable as the binder are those that are transparent or translucent, and that are generally colorless, such as natural resin or polymer and their copolymers; synthetic resin or polymer and their copolymer; or media forming a film; for example, included are rubbers, cellulose acetates, cellulose acetate butyrates, poly(vinyl chlorides), poly(methacrylic acids), styrene-maleic anhydride copolymers, styrene-acrylonitrile copolymers, styrene-butadiene copolymers, poly(vinyl acetals) (e.g., poly (vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent or emulsion to form a coating solution.

The glass transition temperature (Tg) of the binder which can be used in the image forming layer is preferably in a range of from 0° C. to 80° C., more preferably from 10° C. to 70° C. and, even more preferably from 15° C. to 60° C.

In the specification, Tg is calculated according to the following equation:

$$1/Tg=\Sigma(Xi/Tgi)$$

where the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more polymers depending on needs. And, the polymer having Tg of 20° C. or more and the polymer having Tg of less than 20° C. can be used in combination. In the case where two or more polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As the water-miscible organic solvent, there can be used, for example, alcohols such as methyl alcohol, ethyl alcohol, propyl alcohol, or the like; cellosolves such as methyl cellosolve, ethyl cellosolve, butyl cellosolve, or the like; ethyl acetate; dimethylformamide; or the like.

The term "aqueous solvent" is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60% RH $=[(W1-W0)/W0]\times100$ (% by weight)

wherein W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, and is more preferably, in a range of from 0.01% by weight to 1.5% by weight, and is even more preferably, from 0.02% by weight to 1% by weight.

The binders used in the invention are particularly preferably polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodisperse particle diameter distribution. From the viewpoint of controlling the physical properties of the coating solution, preferred mode of usage includes mixing two or more types of dispersed particles each having monodisperse particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

Preferably, 50% by weight or more of the binder is occupied by polymer latex having a monomer component represented by the following formula (M).

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, an alkyl group having 1 to 6 carbon atoms, a halogen atom, or a cyano group.

More preferably, both of $R^{01}$ and $R^{02}$ represent a hydrogen atom, or one of $R^{01}$ or $R^{02}$ represents a hydrogen atom and the other represents a methyl group.

Preferably, the polymer latex contains the monomer component represented by formula (M) within a range of from 10% by weight to 70% by weight, and more preferably from 20% by weight to 60% by weight.

<Examples of Latex>

Specific examples of preferred polymer latexes are given below, which are expressed by the starting monomers with % by weight given in parenthesis. The molecular weight is given in number average molecular weight.

In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)- (molecular weight 37000, Tg 61° C.)

P-2; Latex of -MMA(70)-2EHA(20)-St(5)-AA(5)- (molecular weight 40000, Tg 59° C.)

P-3; Latex of -St(50)-Bu(47)-MAA(3)- (crosslinking, Tg −17° C.)

P-4; Latex of -St(68)-Bu(29)-AA(3)- (crosslinking, Tg 17° C.)

P-5; Latex of -St(71)-Bu(26)-AA(3)- (crosslinking, Tg 24° C.)

P-6; Latex of -St(70)-Bu(27)-IA(3)- (crosslinking)

P-7; Latex of -St(75)-Bu(24)-AA(1)- (crosslinking, Tg 29° C.)

P-8; Latex of -St(60)-Bu(35)-DVB(3)-MAA(2)- (crosslinking)

P-9; Latex of -St(70)-Bu(25)-DVB(2)-AA(3)- (crosslinking)

P-10; Latex of -VC(50)-MMA(20)-EA(20)-AN(5)-AA(5)- (molecular weight 80000)

P-11; Latex of -VDC(85)-MMA(5)-EA(5)-MAA(5)- (molecular weight 67000)

P-12; Latex of -Et(90)-MAA(10)- (molecular weight 12000)

P-13; Latex of -St(70)-2EHA(27)-AA(3)- (molecular weight 130000, Tg 43° C.)

P-14; Latex of -MMA(63)-EA(35)-AA(2)- (molecular weight 33000, Tg 47° C.)

P-15; Latex of -St(70.5)-Bu(26.5)-AA(3)- (crosslinking, Tg 23° C.)

P-16; Latex of -St(69.5)-Bu(27.5)-AA(3)- (crosslinking, Tg 20.5° C.)

P-17; Latex of -St(61.5)-Isoprene(35.5)-AA(3)- (crosslinking, Tg 17° C.)

P-18; Latex of -St(67)-Isoprene(28)-Bu(2)-AA(3)- (crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

<Preferable Latexes>

Particularly preferable as the polymer latex for use in the invention is that of styrene-butadiene copolymer or that of styrene-isoprene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above. Further, the ratio of copolymerization and the like in the styrene-isoprene copolymer are similar to those in the styrene-butadiene copolymer.

As the latex of styrene-butadiene copolymer preferably used in the invention, there can be mentioned P-3 to P-9 and P-15 described above, and commercially available LACSTAR-3307B, 7132C, Nipol Lx416, and the like. And as examples of the latex of styrene-isoprene copolymer, there can be mentioned P-17 and P-18 described above.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like. These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. Concerning the amount of the binder for the image forming layer, the mass ratio of total binder to organic silver salt (total binder/organic silver salt) is preferably in a range of from 1/10 to 10/1, more preferably from 1/3 to 5/1, and even more preferably from 1/1 to 3/1.

The image forming layer is, in general, a photosensitive layer (image forming layer) containing a photosensitive silver halide, i.e., the photosensitive silver salt; in such a case, the mass ratio of total binder to silver halide (total binder/silver halide) is in a range of from 5 to 400, and more preferably from 10 to 200.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a crosslinking agent for crosslinking, a surfactant to improve coating ability, or the like.

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 50% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is preferably 50% by weight or more, and more preferably 70% by weight or more. Specific examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Photosensitive Silver Halide)

For the photosensitive silver halide used in the invention, there is no particular restriction on the halogen composition and silver chloride, silver bromochloride, silver bromide, silver iodobromide, silver iodochlorobromide, and silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

The photosensitive silver halide used for the present invention has two preferable types. One is fine grain-silver halide, and the other is silver halide having an average silver iodide content of 40 mol % or higher, and more preferably tabular silver halide.

1) Fine Grain-silver Halide

The first type of the photosensitive silver halide according to the present invention is fine grain-silver halide. A mean grain size of the photosensitive silver halide is preferably in a range of from 0.01 μm to 0.20 μm, more preferably from 0.01 μm to 0.15 μm and, even more preferably from 0.02 μm to 0.12 μm. The grain size used herein means an average diameter of a circle converted such that it has a same area as a projected area of the silver halide grain (projected area of a major plane in a case of a tabular grain).

For the photosensitive silver halide of this type, there is no particular restriction on the halogen composition and any of silver bromide, silver iodobromide, and silver iodide may be used.

The shape of the silver halide grain can include cubic, octahedral, tabular, spherical, rod-like, or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably, 65% or higher and, even more preferably, 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

<<Coating Amount>>

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, even more preferably, from 0.07 $g/m^2$ to 0.3 $g/m^2$. The photosensitive silver halide is used in a range of from 0.01 mol to 0.5 mol, preferably from 0.02 mol to 0.3 mol, and more preferably from 0.03 mol to 0.2 mol, per 1 mol of the organic silver salt.

2) Silver Halide Having an Average Silver Iodide Content of 40 mol % or Higher

The second type of the photosensitive silver halide according to the present invention is silver halide having an average silver iodide content of 40 mol % or higher, preferably silver halide in which 50% or more of a total projected area of the silver halide grains is occupied by tabular grains having an aspect ratio of 2 or more. Preferable are tabular grains having a mean equivalent circular diameter of from 0.3 μm to 5.0 μm.

More preferably, the aspect ratio is from 5 to 100. Preferably, the average silver iodide content is 80 mol % or higher, and more preferably 90 mol % or higher.

Preferably, the photosensitive silver halide according to the present invention is subjected to gold sensitization.

The photosensitive silver halide grains used for the present invention are explained below in more detail.

The tabular grain used herein means a silver halide grain having two facing parallel principal planes (hereinafter referred as "tabular grain").

On viewing the tabular grain from the vertical direction with respect to the principal plane, the tabular gain often have a shape such as a hexagonal form, a triangle form, a square form, a rectangular form or a circular form with rounded corner. Any form beside the above forms may be used. However, in order to apply uniformly an epitaxial sensitization among grains, monodisperse in size and form is preferred.

The tabular silver halide grain used in the present invention is defined as a silver halide grain having an aspect ratio (equivalent circular diameter of the major plane/grain thickness) of 2 or more. The equivalent circular diameter of a tabular silver halide grain is determined from a diameter (equivalent circular diameter) of a circle having the same area as projected area of a silver halide grain, for example, measured by photomicrographs of transmission electron microscope image with a replica method.

The grain thickness can not be easily derived from a length of the shadow of the replica because of their epitaxial junction portion. However, the thickness may be derived from the measurement of a length of the shadow of the replica before the formation of epitaxial junction portion. Or even after the formation of epitaxial junction portion, the grain thickness can be easily derived from electron photomicrographs of the cross section of sliced specimens of a coated sample containing tabular grains.

The tabular grain in the present invention has an aspect ratio of 2 or more, and preferably the tabular grain used in the present invention has an aspect ratio of from 5 to 100, more preferably from 7 to 100, and most preferably 10 to 100.

The halogen composition of the tabular silver halide grains according to the invention is a composition of a high silver iodide content of 40 mol % or higher. Other components are not particularly limited and can be selected from silver halides such as silver chloride, silver bromide, and the like and organic silver salts such as silver thiocyanate, silver phosphate, and the like. Among them, silver bromide, silver chloride, and silver thiocyanate are preferably used. The silver iodide content used herein means a content of silver iodide comprised in silver halide grains including epitaxial portions. Using such silver halide grains having a high silver iodide content, the photothermographic materials exhibiting excellent properties in the image storability after thermal development, especially the remarkable depression of fog increase caused by light exposure can be attained.

The X-ray diffraction method is well known in the art as for the technique of determination of halogen composition in silver halide crystals. The X-ray diffraction method is fully described in "X-Ray Diffraction Method" of Kiso Bunseki Kagaku Kouza (Lecture Series on Basic Analytical Chemistry), No.24. Normally, an angle of diffraction is measured by the powder method with copper K β radiation as a beam source.

The lattice constant $\underline{a}$ can be calculated from Bragg's equation by finding the angle of diffraction 2θ as follows.

$$2\underline{d}\sin\theta=\lambda$$

$$\underline{d}=\underline{a}/(h^2+k^2+l^2)^{1/2}$$

wherein, 2θ is an angle of diffraction of (hkl) face, λ is a wavelength of X-ray beam used, $\underline{d}$ is spacing between (hkl) faces. The relation between the halogen composition of silver halide solid solution and the lattice constant a is already known (for example, described in T. H. James, "THE THEORY OF THE PHOTOGRAPHIC PROCESS, FOURTH EDITION" (Macmillan New York). Therefore, the halogen composition can be determined from the lattice constant obtained.

The tabular grain of the invention can assume any of a β phase or a γ phase. The term "β phase" described above means a high silver iodide structure having a wurtzite structure of a hexagonal system and the term "γ phase" means a high silver iodide structure having a zinc blend structure of a cubic crystal system. An average content of γ phase in the present invention is determined by a method presented by C. R. Berry. In the method, an average content of γ phase is calculated from the peak ratio of the intensity owing to γ phase (111) to that owing to β phase (100), (101), (002) in powder X ray diffraction method. Detail description, for example, is described in Physical Review, vol. 161 (No. 3), pages 848 to 851 (1967).

Concerning the tabular grains in the present invention, the distribution of the halogen composition in a host tabular grain may be uniform or the halogen composition may be changed stepwise, or it may be changed continuously.

Further, a silver halide grain having a core/shell structure can be preferably used. Preferred structure is a twofold to fivefold structure and, more preferably, core/shell grain having a twofold to fourfold structure can be used.

A core-high-silver iodide-structure, which has a high content of silver iodide in the core part, and a shell-high-silver iodide-structure, which has a high content of silver iodide in the shell part, can also be preferably used. In order to attain the photothermographic material exhibiting excellent image storability after development and depression of fog increase caused by light exposure, tabular host grains having a higher silver iodide content are preferred, and more preferred are tabular grains having a silver iodide content of from 90 mol % to 100 mol %.

<<Grain Size>>

Concerning the tabular grains used in the present invention, any grain size enough to reach the required high sensitivity can be selected. In the present invention, preferred silver halide grains are those having a mean equivalent spherical diameter of 0.3 μm to 5.0 μm, and more preferred are those having a mean equivalent spherical diameter of 0.3 μm to 3.0 μm. The term "equivalent spherical diameter" used here means a diameter of a sphere having the same volume as the volume of a silver halide grain.

As for measuring method, an equivalent spherical diameter is calculated from measuring equvalent circular diameter and thickness similar to the aforesaid measurement of an aspect ratio. The smaller equivalent circular diameter and the thinner grain thickness may normally result in increasing the number of grains and broadening the distribution of epitaxial junctions among grains. Thereby, the effect of the present invention becomes more remarkable.

<<Epitaxial Junction Portion>>

The tabular silver halide grain according to the present invention preferably has an epitaxial junction portion. The multifold structure may be a twofold structure, threefold structure, or higher dimension of multifold structure. One example is a twofold structure consisted of a core part and a shell part, in which preferably the core part has a silver chloride content of 40 mol % or higher and the shell part has a silver chloride content of 30 mol % or lower, and more preferably the core part comprises silver chloride and the shell part comprises silver bromide.

Concerning threefold structure, the epitaxial junction portion is consisted of a core part, an intermediate part, and a shell part, in which preferably at least one of the core part and the intermediate part has a silver iodide content of 4 mol % or higher. More preferably the intermediate part has a silver iodide content of 10 mol % or higher, and even more preferably the core part comprises silver chloride or silver bromide, the intermediate part comprises silver iodide, and the shell part comprises silver bromide, and most preferably the core part comprises silver chloride.

In the present invention, the epitaxial junction portion can be formed onto an apex portion, a major plane, or an edge portion of the tabular grain, and more preferably onto the apex portion. The tabular grain has at least one epitaxial junction portion, preferably two or more epitaxial junction portions, and most preferably four or more epitaxial junction portions.

The tabular grain having an epitaxial junction portion of the present invention preferably has a dislocation line in the epitaxial junction portion. The dislocation line is often formed accidentally in the epitaxial portion caused by the composition difference between the tabular host grain and the epitaxial portion, but the intended introduction of dislocation lines in the grains by controlling the condition for forming the epitaxial junction portion is more preferred.

Here, it is preferred that no dislocation line is substantially observed in the tabular host grain. The coexistence of the dislocation lines in both the tabular host grain and the epitaxial portion is not preferred because the efficiency of latent image formation is depressed to give a low sensitivity.

The size of epitaxial junction portion according to the present invention, with respect to host grain portion, is preferably in a range of from 1 mol % to 60 mol %, based on mole of silver ion, more preferably from 3 mol % to 50 mol %, even more preferably from 5 mol % to 30 mol %, and most preferably from 10 mol % to 20 mol %.

<<Coating Amount>>

Generally, in the case of photothermographic material where silver halide is remained thereon after thermal development, the coating amount of silver halide is limited to a lower level in spite of the requirement for high sensitivity. It is because the increase of the coating amount of silver halide may result in decreasing the film transparency and deteriorating the image quality. However, according to the present invention, more amount of silver halide can be coated because thermal development can decrease the haze of film caused by the residual silver halide. In the present invention, the preferred coating amount is in a range from 0.5 mol % to 100 mol %, per 1 mol of non-photosensitive organic silver salt, and more preferably from 5 mol % to 50 mol %.

3) Heavy Metal

The photosensitive silver halide grain of the invention preferably contains a heterometal other than silver atom in the grain. As the heterometal other than silver atom, metals or complexes of metals belonging to groups 6 to 13 of the periodic table (showing groups 1 to 18) are preferred. More preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more complexes comprising identical or different species of metals may be used together. The content is preferably in a range from $1\times10^{-9}$ mol to $1\times10^{-3}$ mol per 1 mol of silver. The heavy metals, metal complexes and the addition method thereof are described in JP-A No. 7-225449, in paragraph Nos. 0018 to 0024 of JP-A No.11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization, and tellurium sensitization or noble metal sensitization such as gold sensitization, during a washing step, during a dispersion step, or before a chemical sensitization step. In order not to grow fine silver halide grains, the hexacyano metal complex is rapidly added preferably after the grain is formed, and it is preferably added before completion of an emulsion formation step.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No.11-65021, and paragraph Nos. 0242 to 0250 of JP-A No.11-119374.

4) Chemical Sensitization

The photosensitive silver halide used for the present invention may be used without chemical sensitization, but is preferably chemically sensitized by at least one of chalcogen sensitizing method, gold sensitizing method, and reduction sensitizing method. The chalcogen sensitizing method includes sulfur sensitizing method, selenium sensitizing method and tellurium sensitizing method.

The photosensitive silver halide used for the invention is more preferably chemically sensitized by at least one method of gold sensitizing method and chalcogen sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea, or carboxymethyltrimethylthiourea), thioamides (e.g., thioacetamide), rhodanines (e.g., diethylrhodanine or 5-benzylydene-N-ethylrhodanine), phosphinesulfides (e.g., trimethylphosphinesulfide), thiohydantoins, 4-oxo-oxazolidin-2-thiones, disulfides or polysulfides (e.g., dimorphorinedisulfide, cystine, or lenthionine (1,2,3,5,6-pentathiepane)), polythionates, and sulfur element, and active gelatin can be used. Specifically, thiosulfates, thioureas, and rhodanines are preferred.

In selenium sensitization, unstable selenium compounds can be used. These unstable selenium compounds are described in Japanese Patent Application Publication (JP-B) Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea, or acetyltrimethylselemourea), selenoamides (e.g., selenoamide or N,N-diethylphenylselenoamide), phosphineselenides (e.g., triphenylphosphineselenide or pentafluorophenyl-triphenylphosphineselenide), selenophosphates (e.g., tri-p-tolylselenophosphate or tri-n-butylselenophosphate), selenoketones (e.g., selenobenzophenone), isoselenocyanates, selenocarbonic acids, selenoesters, diacylselenides, or the like can be used. Furthermore, non-unstable selenium compounds such as selenius acid, salts of selenocyanic acid, selenazoles, and selenides described in JP-B Nos. 46-4553 and 52-34492, and the like can also be used. Specifically, phosphineselenides, selenoureas, and salts of selenocyanic acids are preferred.

In tellurium sensitization, unstable tellurium compounds are used. Unstable tellurium compounds described in JP-A Nos.4-224595, 4-271341, 4-333043, 5-303157, 6-27573, 6-175258, 6-180478, 6-208186, 6-208184, 6-317867, 7-140579, 7-301879, 7-301880, and the like, can be used as a tellurium sensitizer.

As typical examples of a tellurium sensitizer, phosphinetellurides (e.g., butyl-diisopropylphosphinetelluride, tributylphosphinetelluride, tributoxyphosphinetelluride, or ethoxy-diphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, or bis(ethoxycarbonyl)telluride), tellureoureas (e.g., N,N'-dimethylethylenetellurourea or N,N'-diphenylethylenetellurourea), telluroamides, or telluroesters may be used. Specifically, diacyl(di)tellurides and phosphinetellurides are preferred. Especially, the compounds described in paragraph No. 0030 of JP-A No.11-65021 and compounds represented by formulae (II), (III), or (IV) in JP-A No.5-313284 are preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. More specifically, chloroauric acid, potassium chloroaurate, potassium aurithiocyanate, gold sulfide, gold selenide, or the like can be used. In addition to these, the gold compounds described in U.S. Pat. Nos. 2,642,361, 5,049,484, 5,049,485, 5,169,751, and 5,252,455, Belg. Patent No. 691857, and the like can also be used.

Noble metal salts other than gold such as platinum, palladium, iridium and the like, which are described in Chimie et Pysique Photographique, written by P. Grafkides, (Paul Momtel, 5th ed., 1987) and Research Disclosure (vol. 307, Item 307105), can also be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The addition amount of chalcogen sensitizer used in the invention may vary depending on the silver halide grain used, the chemical ripening condition, and the like, and it is from $10^{-8}$ mol to $10^{-1}$ mol, and preferably from about $10^{-7}$ mol to about $10^{-2}$ mol, per 1 mol of silver halide.

Similarly, the addition amount of the gold sensitizer used in the invention may vary depending on various conditions and it is generally from $10^{-7}$ mol to $10^{-2}$ mol and, more preferably, from $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is from 3 to 10, preferably, from 4 to 9; and the temperature is at from 20° C. to 95° C., preferably, from 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred. The reduction sensitizer may be added at any stage in the photosensitive emulsion producing process from crystal growth to the preparation step just before coating.

Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally from $10^{-7}$ mol to $10^{-1}$ mol and, more preferably, from $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

5) Compound that is One-Electron-Oxidized to Provide a One-Electron Oxidation Product which Releases One or More Electrons The photothermographic material of the invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound is be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). And preferable ranges of these compounds are the same as the preferable ranges described in the quoted specifications.

Formula (1)

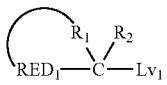

Formula (2)

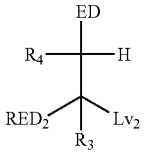

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

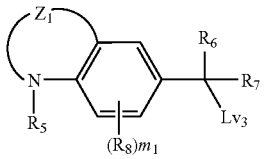

-continued

Formula (4)

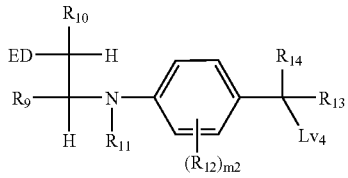

Formula (5)

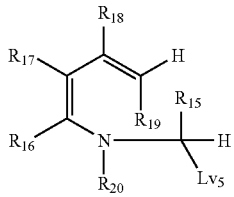

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent; however, in the case where $R_{20}$ represents a group other than an aryl group, $R_{16}$ and $R_{17}$ bond to each other to form an aromatic ring or a hetero aromatic ring. $R_8$ and $R_{12}$ represent a substituent substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

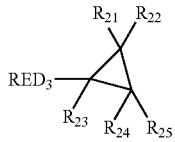

Formula (7)

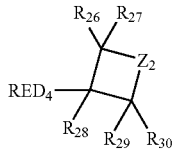

In formulae (6) and (7), $RED_3$ and $RED_4$ each independently represent a reducing group. $R_{21}$ to $R_{30}$ each independently represent a hydrogen atom or a substituent. $Z_2$ represents one selected from $—CR_{111}R_{112}—$, $—NR_{113}—$, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

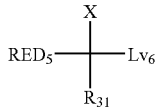

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Reaction formula (1)

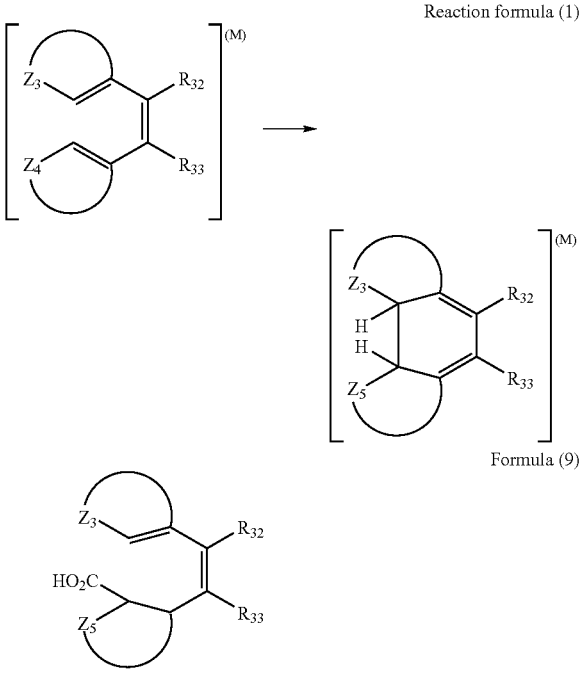

Formula (9)

The compound represented by formula (9) is a compound that undergoes a bonding reaction represented by reaction formula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5 or 6-membered heterocycle with C═C. $Z_4$ represents a group to form a 5 or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5 or 6-membered cyclic aliphatic hydrocarbon group or heterocyclic group with C—C.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). Preferable ranges of these compounds are the same as the preferable ranges described in the quoted specifications.

$RED_6$-Q-Y

Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

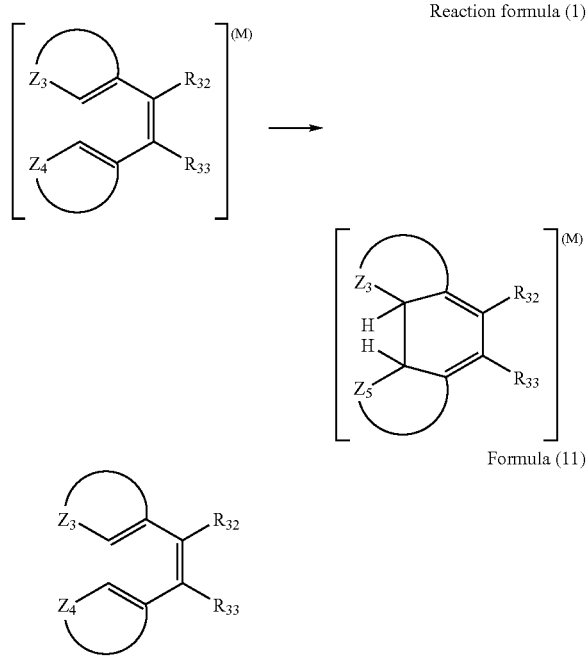

Formula (11)

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5 or 6-membered aryl group or heterocyclic group with C═C. $Z_5$ represents a group to form a 5 or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (—N(Ag)—) (e.g., a benzotriazole group, a benzimidazole group, an indazole group, or the like) are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

Formula (X)

$$(P—Q_1)_i—R—(Q_2—S)_j$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(=O)—, —$SO_2$—, —SO—, —P(=O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

Specific examples of the compounds of Groups 1 or 2 according to the invention are shown below without intention of restricting the scope of the invention.

1
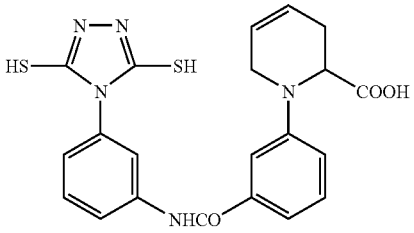
2
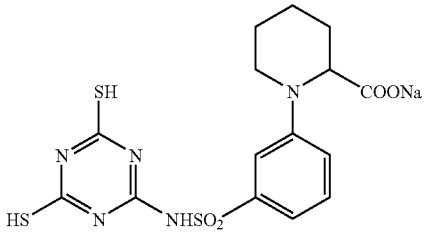
3
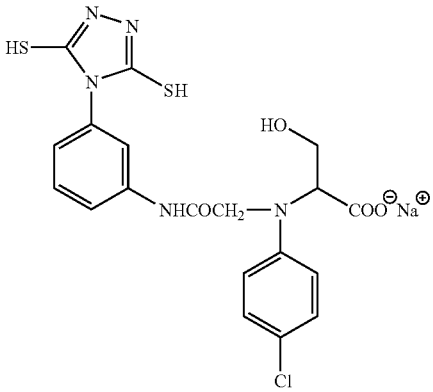
4
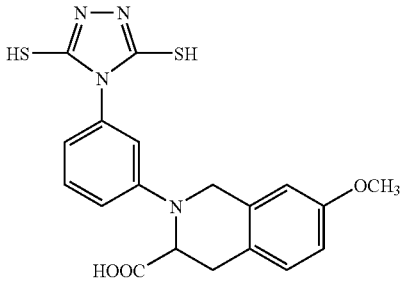
5
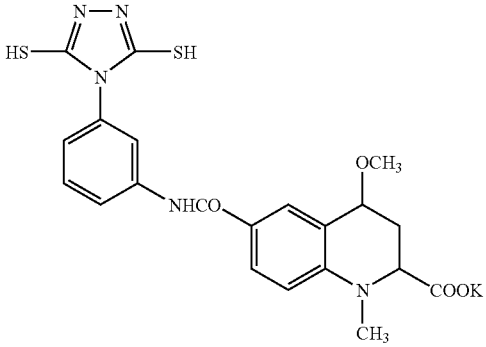
6
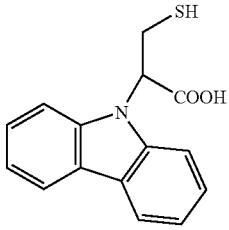
7
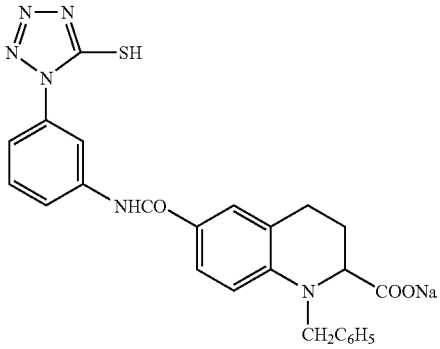
8
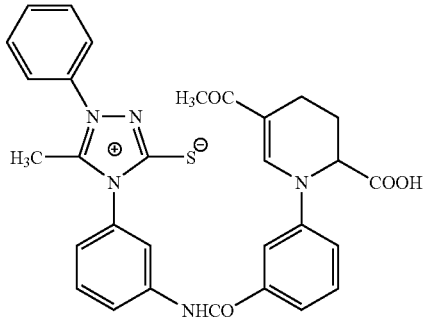
9
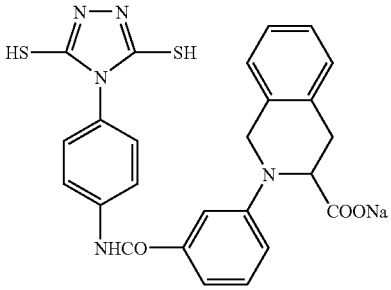
10
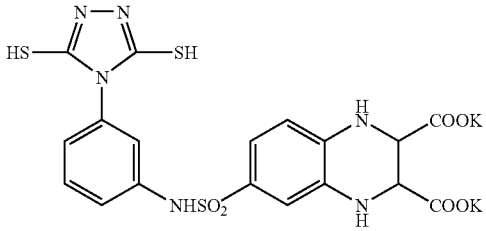

-continued
11
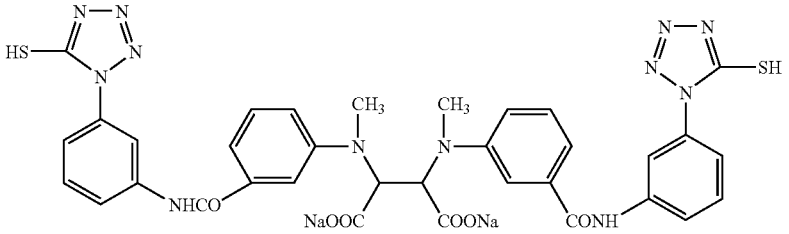
12
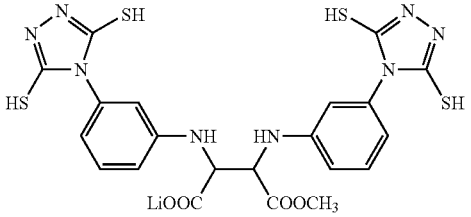
13
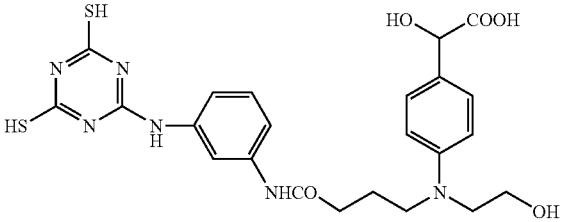
14
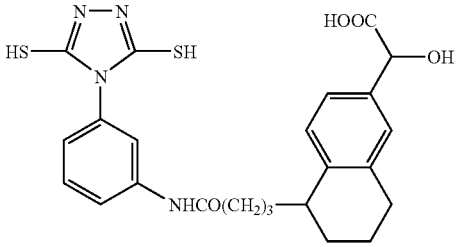
15
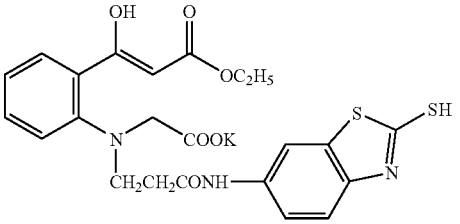
16
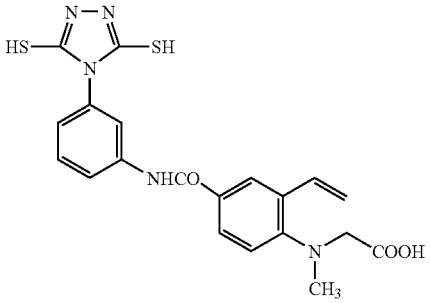
17
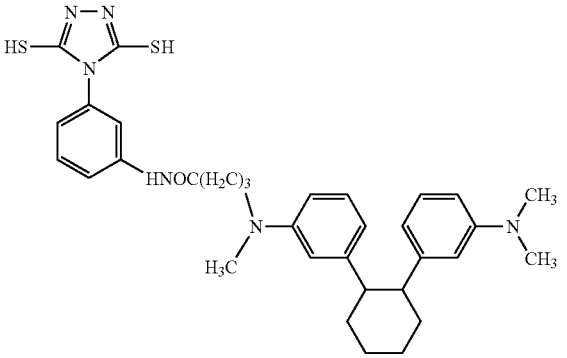
18
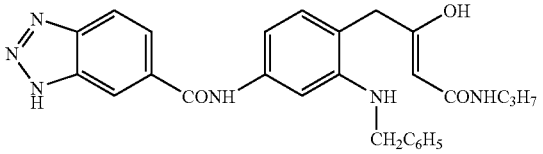
19
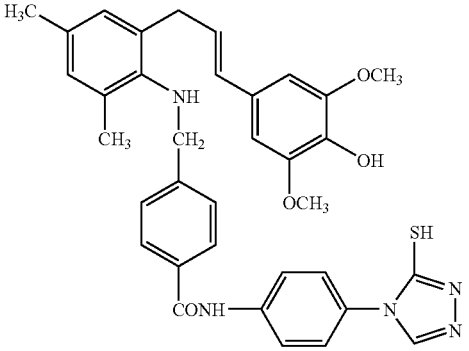

-continued
20
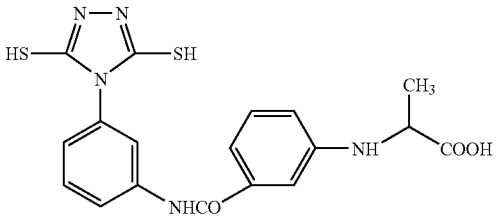
21
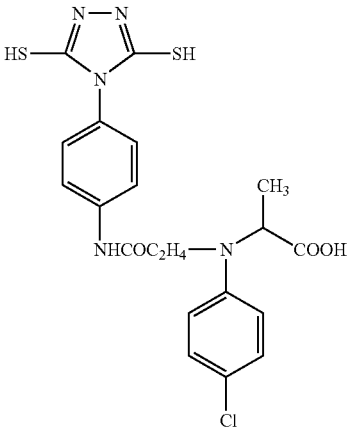
22
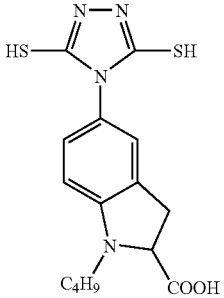
23
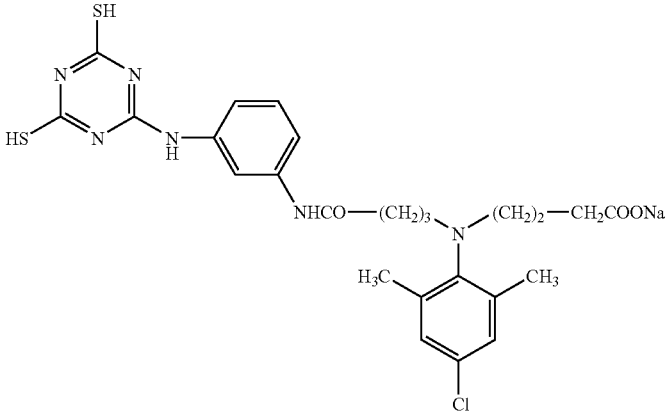
24
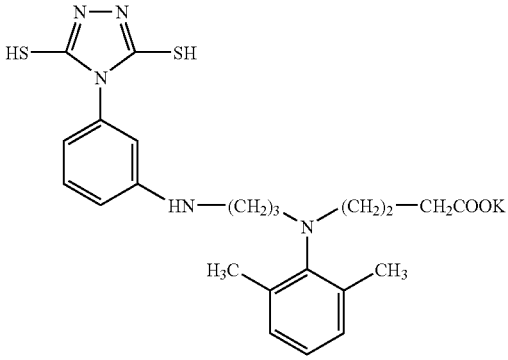
25
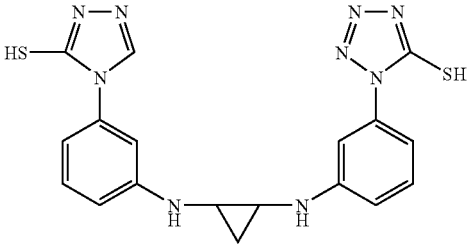

-continued
26
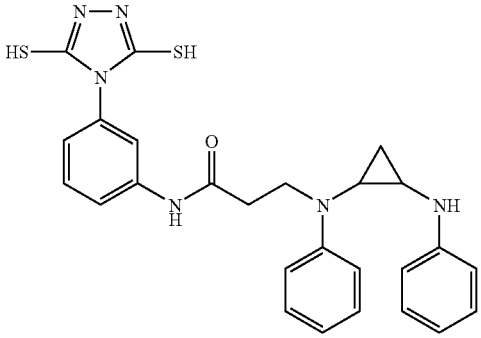
27
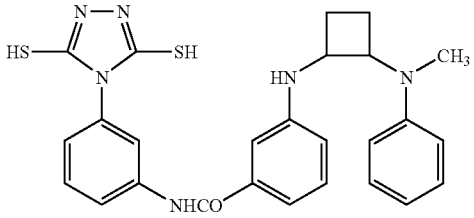
28
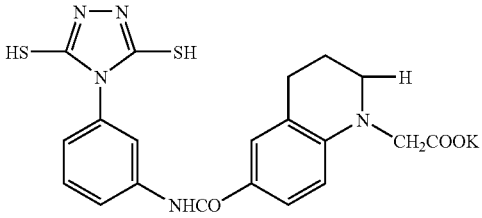
29
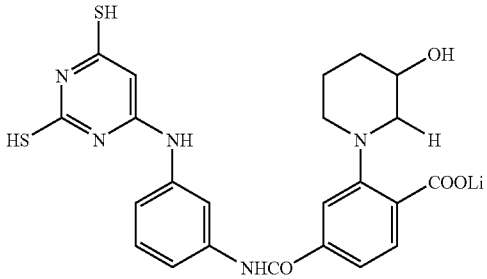
30
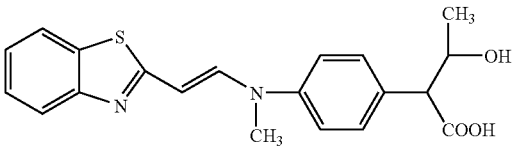
31
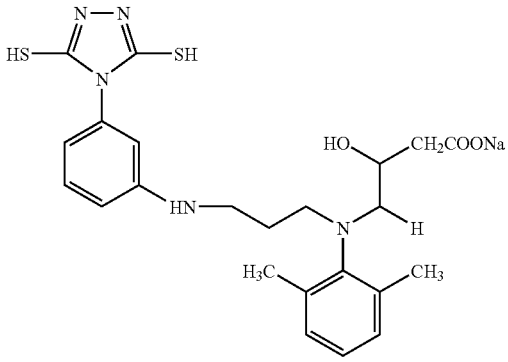
32
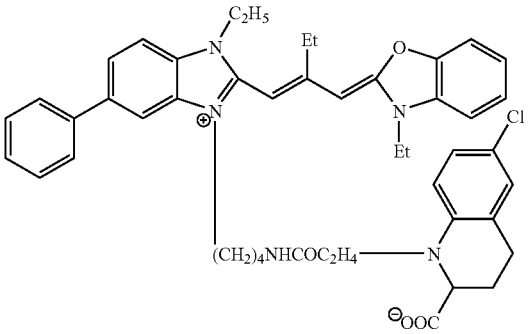
33
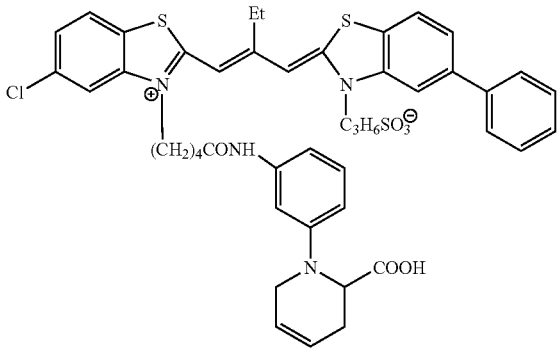
34
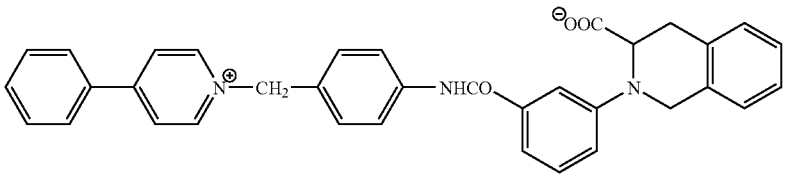

-continued

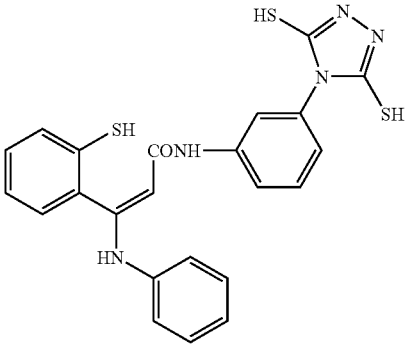

G-1

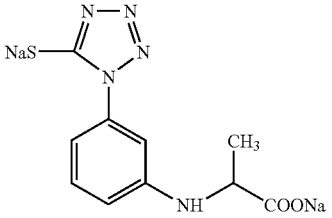

G-2

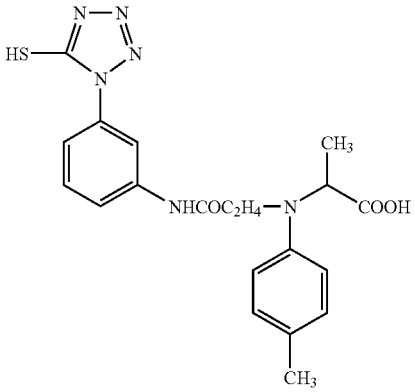

G-3

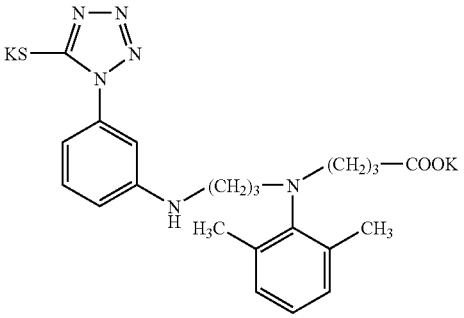

G-4

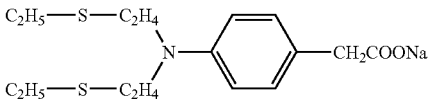

G-5

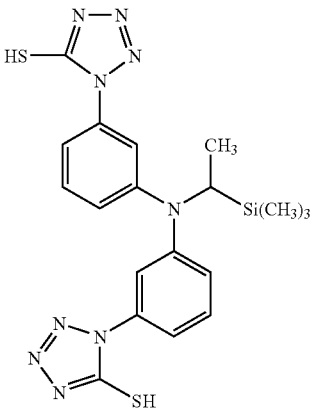

6) Compound having Adsorptive Group and Reducing Group

The photothermographic material of the present invention preferably comprises a compound having an adsorptive group to silver halide and a reducing group in a molecule. It is preferred that the compound is represented by the following formula (AF-I).

A-(W)n-B Formula (AF-I)

In formula (AF-I), A represents a group capable of adsorption to a silver halide (hereafter, it is called an adsorptive group); W represents a divalent linking group; n represents 0 or 1; and B represents a reducing group.

In formula (AF-I), the adsorptive group represented by A is a group to adsorb directly to a silver halide or a group to promote adsorption to a silver halide. As typical examples, a mercapto group (or a salt thereof), a thione group (—C(=S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also includes a linear or cyclic thioamide group, thioureido group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (—N(Ag)—) or a heterocyclic group, having an —S— group, a —Se— group, a —Te— group or a =N— group as a partial structure of a heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (AF-I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (—N(Ag)—) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (AF-I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (AF-I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (AF-I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%: 90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (AF-I), a reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (AF-I) according to the present invention may have the ballasted group or polymer chain in it generally used in the non-moving photographic additives as a coupler. And as a polymer, for example, the polymer described in JP-A No. 1-100530 can be selected.

The compound of formula (AF-I) according to the present invention may be bis or tris type of compound. The molecular weight of the compound represented by formula (AF-I) according to the present invention is preferably from 100 to 10000, more preferably from 120 to 1000, and particularly preferably from 150 to 500.

The examples of the compound represented by formula (AF-I) according to the present invention are shown below, but the present invention is not limited in these.

(1)

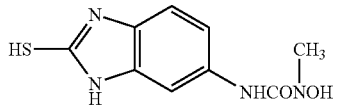

(2)

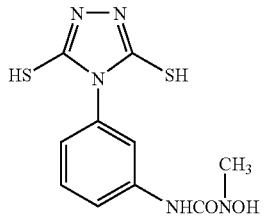

(3)

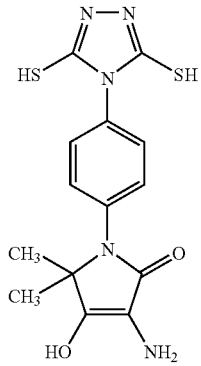

(4)

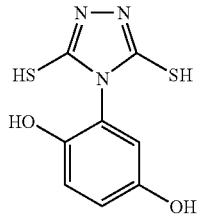

(5)

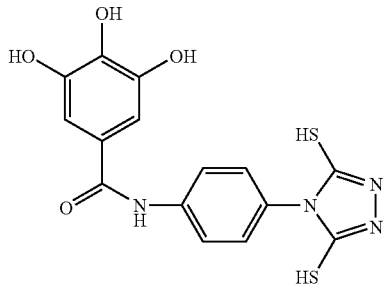

-continued (6)

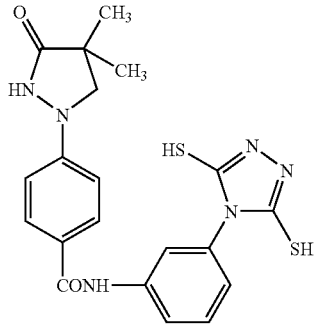

(7)

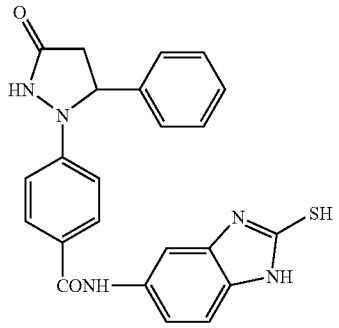

(8)

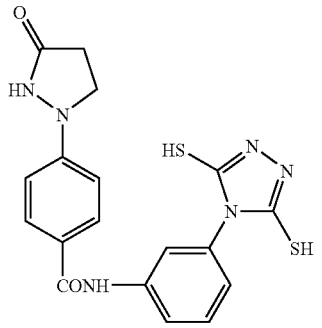

(9)

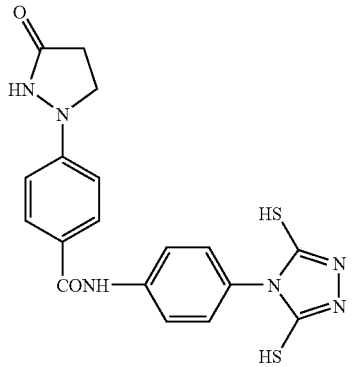

-continued (10)

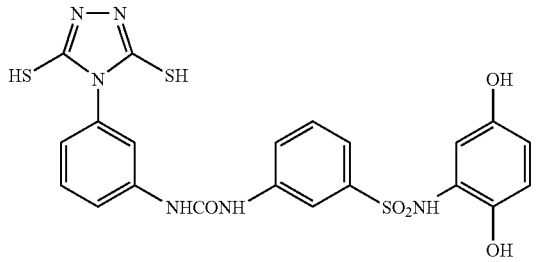

(11)

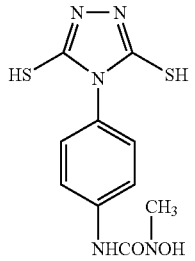

(12)

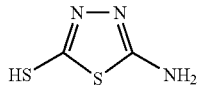

(13)

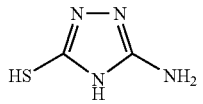

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (AF-I) according to the present invention can be used alone, but it is preferred to use two or more of the compounds in combination. When two or more of the compounds are used in combination, those may be added to the same layer or the different layers, whereby adding methods may be different from each other.

The compound represented by formula (AF-I) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (AF-I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

7) Compound which Substantially Reduces Visible Light Absorption by Photosensitive Silver Halide after Thermal Development In the present invention, it is preferred that the photothermographic material contains a compound which substantially reduces visible light absorption by photosensitive silver halide after thermal development relative to that before thermal development.

In the present invention, it is particularly preferred that a silver iodide complex-forming agent is used as the compound which substantially reduces visible light absorption by photosensitive silver halide after thermal development.

<Silver Iodide Complex-forming Agent>

Concerning the silver iodide complex-forming agent according to the present invention, at least one of a nitrogen atom and a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion, and the silver complex forming agent. As a general guide, it is possible to obtain a large stability constant by a chelate effect from intramolecular chelate ring formation, by means of increasing the acid-base dissociation constant or the like.

In the present invention, the ultra violet-visible light absorption spectrum of the photosensitive silver halide can be measured by a transmission method or a reflection method. When the absorption derived from other compounds added to the photothermographic material overlaps with the absorption of photosensitive silver halide, the ultra violet-visible light absorption spectrum of photosensitive silver halide can be observed by using, independently or in combination, the means of difference spectrum or removal of other compounds by solvent, or the like.

As a silver iodide complex-forming agent according to the present invention, a 5- to 7-membered heterocyclic compound containing at least one nitrogen atom is preferable. In the case where the compound does not have a mercapto group, a sulfide group, or a thione group as a substituent, the said nitrogen containing 5- to 7-membered heterocycle may be saturated or unsaturated, and may have another substituent. The substituents on a heterocycle may bond to each other to form a ring.

As preferable examples of 5- to 7-membered heterocyclic compounds, pyrrole, pyridine, oxazole, isooxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phthalazine, triazine, 1,8-naphthylizine, 1,10-phenanthroline, and the like can be described.

These rings may have a substituent and any substituent can be used as far as it does not negatively impact the photographic property. As preferable examples, a halogen atom (fluorine atom, chlorine atom, bromine atom, or iodine atom), an alkyl group (a straight, a branched, a cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group.

Herein, two electron-attracting groups may bond to each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $—SO_3^-$, $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, naththilizine, or phenanthroline derivative, the acid dissociation constant (pKa) of a conjugated acid of nitrogen containing heterocyclic part in acid dissociation equilibrium of the said compound is preferably from 3 to 8 in the mixture solution of tetrahydrofuran/water (3/2) at 25° C., and more preferably, the pKa is from 4 to 7.

As the heterocyclic compound, pyridine, pyridazine, and a phthalazine derivative are preferable, and particularly preferable are pyridine and a phthalazine derivative.

In the case where these heterocyclic compounds have a mercapto group, a sulfide group, or a thione group as the substituent, pyridine, thiazole, isothiazole, oxazole, isooxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable.

For example, as the said silver iodide complex-forming agent, the compound represented by the following formulae (1) or (2) can be used.

Formula (1)

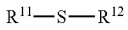

Formula (2)

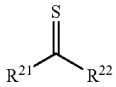

In formula (1), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5- to 7-membered nitrogen containing heterocyclic type silver iodide complex-forming agent mentioned above can be described.

Further, the compound represented by formula (3) described below can also be used preferably.

Formula (3)

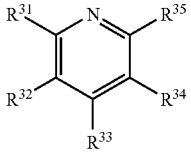

In formula (3), $R^{31}$ to $R^{35}$ each independently represent a hydrogen atom or a substituent. As the substituent represented by $R^{31}$ to $R^{35}$, the substituent of a 5- to 7-membered nitrogen containing heterocyclic type silver iodide complex-forming agent mentioned above can be used. In the case where the compound represented by formula (3) has a substituent, preferred substituting position is $R^{32}$ to $R^{34}$. $R^{31}$ to $R^{35}$ may bond to each other to form a saturated or an unsaturated ring. A preferred substituent is a halogen atom, an alkyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part is preferably from 3 to 8 in the mixed solution of tetrahydrofuran/water (3/2) at 25° C., and particularly preferably, from 4 to 7.

Furthermore, the compound represented by formula (4) is also preferable.

Formula (4)

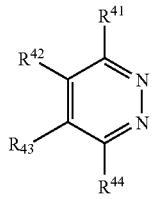

In formula (4), $R^{41}$ to $R^{44}$ each independently represent a hydrogen atom or a substituent. $R^{41}$ to $R^{44}$ may bond to each other to form a saturated or an unsaturated ring. As the substituent represented by $R^{41}$ to $R^{44}$, the substituent of a 5- to 7-membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one substituent. As examples of $R^{51}$ to $R^{56}$ in formula (5), the substituent of a 5- to 7-membered nitrogen containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group, and the like are described.

An alkyl group, an alkenyl group, an aryl group, an alkoxy group, and an aryloxy group are preferable and an alkyl group, an alkoxy group, and an aryloxy group are more preferable.

Formula (5)

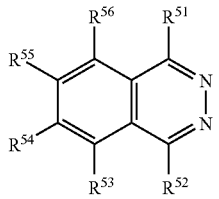

Further, the compound represented by formula (6) described below is also a preferable embodiment.

Formula (6)

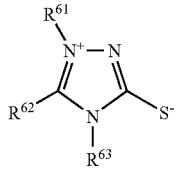

In formula (6), $R^{61}$ to $R^{63}$ each independently represent a hydrogen atom or a substituent. As examples of the substituent, the substituent of a 5- to 7-membered nitrogen containing heterocyclic type silver iodide complex-forming agent mentioned above can be described.

As the compound preferably used, the compound represented by the following formula (7) is described.

Formula (7)

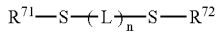

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imide group and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

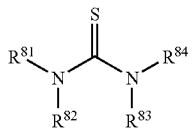

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples.

Among the silver iodide complex-forming agents described above, the compounds represented by formulae (3), (4), (5), (6), or (7) are more preferable and, the compounds represented by formulae (3) or (5) are particularly preferable.

Preferable examples of silver iodide complex-forming agent are described below, however the present invention is not limited in these.

(1)
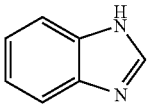
(2)
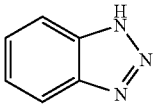
(3)
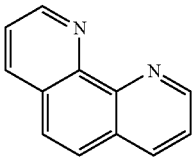
(4)
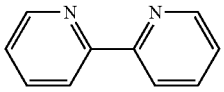
(5)
$C_5H_{11}SC_5H_{11}$
(6)
$C_4H_9SCH_2CH_2SC_4H_9$
(7)
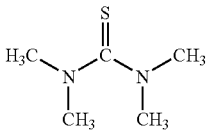
(8)
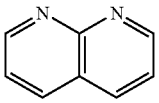
(9)
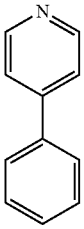
(10)
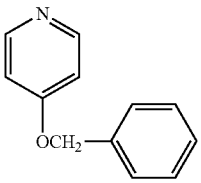
(11)
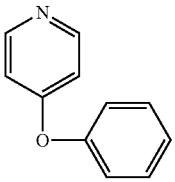
-continued
(12)
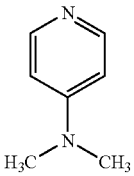
(13)
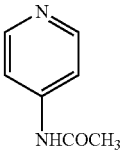
(14)
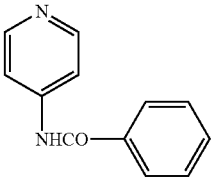
(15)
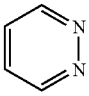
(16)
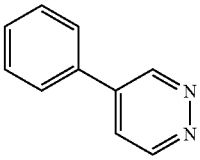
(17)
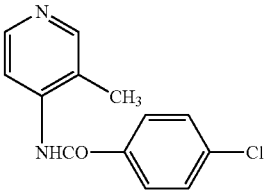
(18)
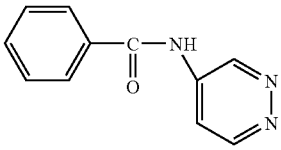
(19)
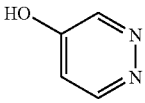
(20)
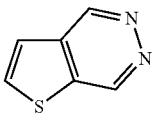
(21)
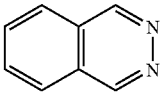

-continued
(22)
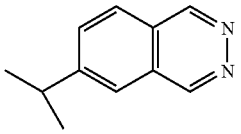
(23)
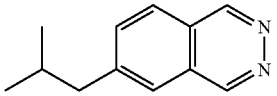
(24)
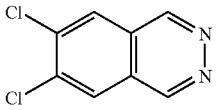
(25)
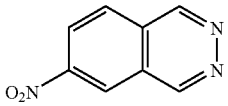
(26)
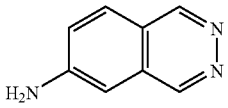
(27)
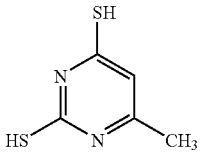
(28)
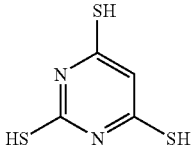
(29)
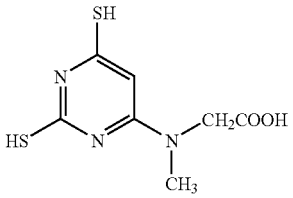
(30)
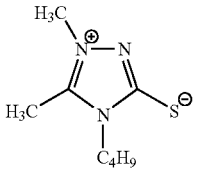
(31)
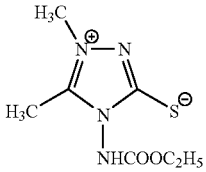
-continued
(32)
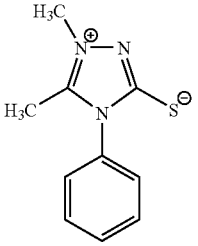
(33)
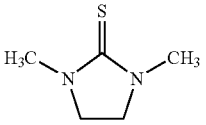
(34)
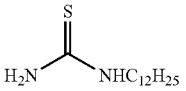
(35)
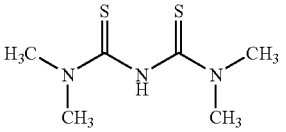
(36)
$HO(CH_2)_3S(CH_2)_2S(CH_2)_3OH$
(37)
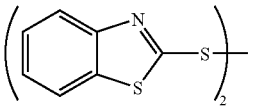
(38)
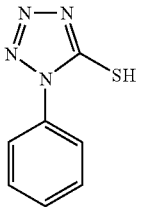
(39)
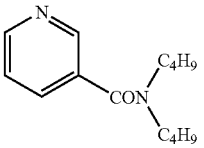
(40)
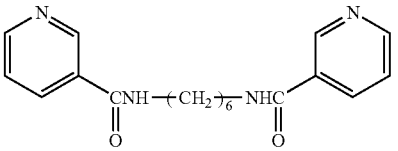
(41)
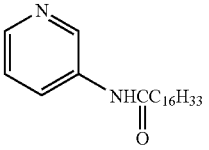

-continued (42)

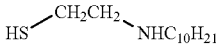

The silver iodide complex-forming agent according to the present invention can also be a compound common to a toner, in the case where the agent achieves the function of conventionally known toner. The silver iodide complex-forming agent according to the present invention can be used in combination with a toner. And, two or more of the silver iodide complex-forming agents may be used in combination.

The silver iodide complex-forming agent according to the present invention preferably exists in a film under the state separated from a photosensitive silver halide, such as a solid state or the like. It is also preferably added to the layer adjacent to the image forming layer. Concerning the silver iodide complex-forming agent according to the present invention, a melting point of the compound is preferably adjusted to a suitable range so that it can be dissolved when heated at thermal developing temperature.

In the present invention, the absorption intensity of ultra violet-visible light absorption after thermal development is preferably decreased to 80% or less of that before thermal development. More preferably, it is decreased to 40% or less of that before thermal development, and particularly preferably 10% or less.

The silver iodide complex-forming agent according to the invention may be incorporated into a photothermographic material by being added into the coating solution, such as in the form of a solution, an emulsified dispersion, a solid fine particle dispersion, or the like.

Well known emulsified dispersing methods include a method comprising dissolving the silver iodide complex-forming agent in an oil such as dibutyl phthalate, tricresylphosphate, glyceryl triacetate, diethyl phthalate, or the like, using an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion.

In this case, there may also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Depending on the dispersing conditions, the amount of Zr or the like incorporated in the dispersion is generally in a range of from 1 ppm to 1000 ppm. It is practically acceptable as far as Zr is incorporated in the photothermographic material in an amount of 0.5 mg or less per 1 g of silver.

Preferably, an antiseptic (for instance, benzisothiazolinone sodium salt) is added in an aqueous dispersion.

The silver iodide complex-forming agent according to the invention is preferably used in the form of a solid dispersion.

The silver iodide complex-forming agent according to the invention is preferably used in a range of from 1 mol % to 5000 mol %, more preferably, from 10 mol % to 1000 mol % and, even more preferably, from 50 mol % to 300 mol %, with respect to the photosensitive silver halide in each case.

8) Combined Use of a Plurality of Silver Halides

The photosensitive silver halide emulsion in the photothermographic material used in the invention may be used alone, or two or more of them (for example, those of different average particle sizes, different halogen compositions, of different crystal habits and of different conditions for chemical sensitization) may be used together. Gradation can be controlled by using plural photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

9) Mixing Photosensitive Silver Halide and Organic Silver Salt

The method of mixing separately prepared the photosensitive silver halide and the organic silver salt can include a method of mixing prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling the photographic properties.

10) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, U.S. Pat. No. 6,083,681, and EP No. 1048975.

1) Organic Polyhalogen Compound

Preferable organic polyhalogen compound that can be used in the invention is explained specifically below. In the invention, preferred organic polyhalogen compound is the compound expressed by the following formula (H).

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant a p yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(=O)—, —SO—, —$SO_2$—, —C(=O)N(R)—, or —$SO_2$N(R)—; more preferably, —C(=O)—, —$SO_2$—, or —C(=O)N(R)—; and particularly preferably, —$SO_2$— or —C(=O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(=O)N(R)—. And, in the case where Q is an aryl group or a heterocyclic group, Y is preferably —$SO_2$—.

In formula (H), the form where the residues, which are obtained by removing a hydrogen atom from the compound, bind to each other (generally called bis type, tris type, or tetrakis type) is also preferably used.

In formula (H), the form having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonio group, a pyridinium group, or the like), a polyethyleneoxy group, a hydroxy group, or the like is also preferable.

Specific examples of the compound expressed by formula (H) of the invention are shown below.

H-1

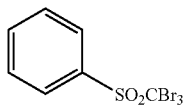

-continued

H-2

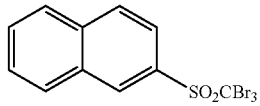

H-3

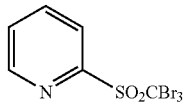

H-4

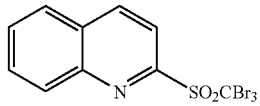

H-5

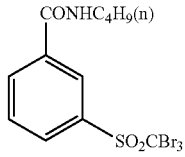

H-6

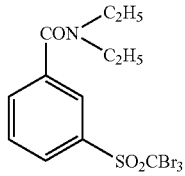

H-7

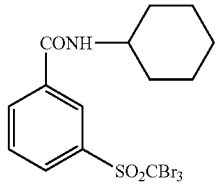

H-8

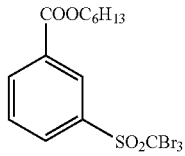

H-9

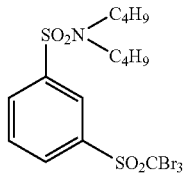

H-10

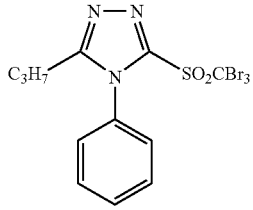

-continued

H-11

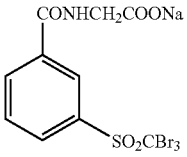

H-12

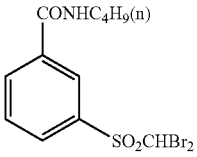

H-13

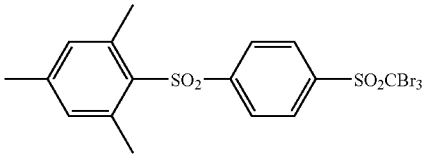

H-14

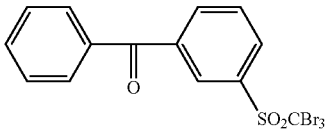

H-15

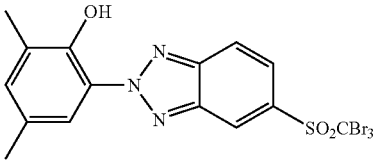

H-16

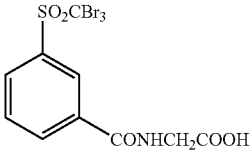

H-17

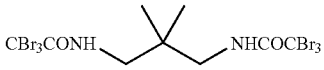

H-18

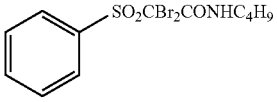

H-19

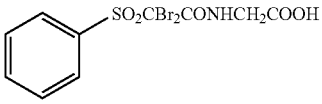

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compound represented by formula (H) of the invention is preferably used in an amount of from $10^{-4}$ mol to 1 mol, more preferably, from $10^{-3}$ mol to 0.5 mol, and further preferably, from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in JP-B No. 55-12581, and a compound expressed by formula (II) in JP-A No. 60-153039.

The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used.

Further, it may be added as a solution having mixed therein other additives such as sensitizing agents, reducing agents, toners, and the like. In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storage properties before and after development. Descriptions can be found in paragraph numbers 0067 to 0069 of JP-A No. 10-62899, a compound expressed by formula (I) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, and 2002-303951, and the like are preferred.

2) Toner

In the photothermographic material of the present invention, the addition of a toner is preferred. Description on the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well-known plasticizer and lubricant can be used to improve physical properties of film. Particularly, to improve handling facility during manufacturing process or resistance to scratch during thermal development, it is preferred to use a lubricant such as a liquid paraffin, a long chain fatty acid, an amide of a fatty acid, an ester of a fatty acid, or the like. Particularly preferred are a liquid paraffin obtained by removing components having a low boiling point and an ester of a fatty acid having a branch structure and a molecular weight of 1000 or more.

Concerning plasticizers and lubricants usable in the image forming layer and in the non-photosensitive layer, compounds described in paragraph No. 0117 of JP-A No. 11-65021 and in JP-A Nos. 2000-5137, 2004-219794, 2004-219802, and 2004-334077 are preferable.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

The addition amount of the nucleator is preferably in a range of from $10^{-5}$ mol to 1 mol, and more preferably from $10^{-4}$ mol to $5\times10^{-1}$ mol, per 1 mol of organic silver salt.

The nucleator may be incorporated into a photothermographic material by being added into the coating solution, such as in the form of a solution, an emulsified dispersion, a solid fine particle dispersion, or the like.

As well known emulsified dispersing method, there can be mentioned a method comprising dissolving the nucleator in an oil such as dibutyl phthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsified dispersion is mechanically produced. During the process, for the purpose of controlling viscosity of oil droplet and refractive index, the addition of polymer such as α-methylstyrene oligomer, poly(t-butylacrylamide), or the like is preferable.

As a solid particle dispersing method, there can be mentioned a method comprising dispersing the powder of the nucleator in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The nucleator is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

Specific examples of the nucleator which can be used in the present invention are shown below, but the invention is not limited in these.

SH-1

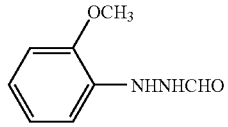

SH-2

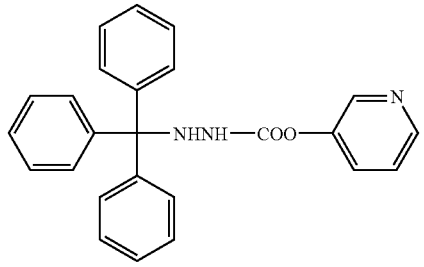

SH-3

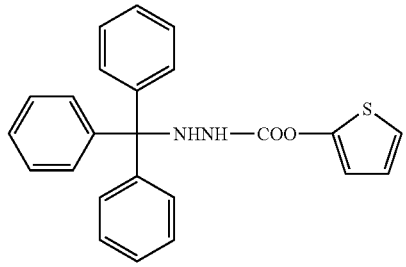

-continued

SH-4

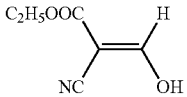

SH-5

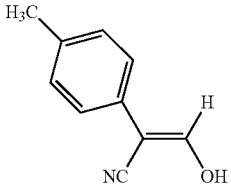

SH-6

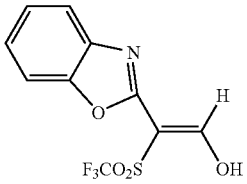

SH-7

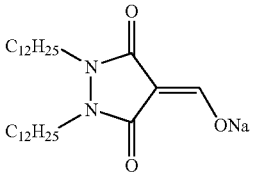

SH-8

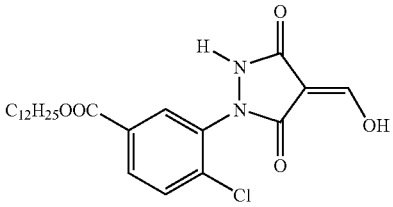

SH-9

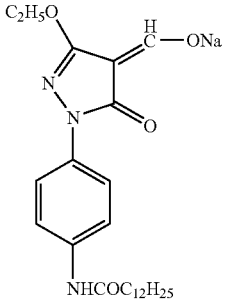

SH-10

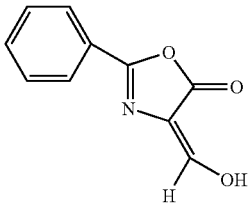

SH-11

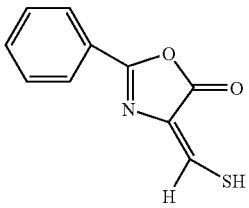

-continued

SH-12

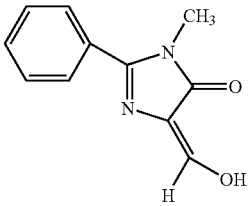

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Constituent Components)

The photothermographic material of the invention has one or more image forming layers constructed on a support. In the case of constituting the image forming layer from one layer, the image forming layer comprises an organic silver salt, a photosensitive silver halide, a reducing agent, and a binder, and may further comprise additional materials as desired and necessary, such as an antifoggant, a toner, a film-forming promoting agent, and other auxiliary agents. In the case of constituting the image forming layer from two or more layers, the first image forming layer (in general, a layer placed nearer to the support) contains an organic silver salt and a photosensitive silver halide. Some of the other components are incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the image forming layers as described in U.S. Pat. No. 4,460,681.

The photothermographic material according to the invention can have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite from the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified poly(vinyl alcohol) MP-203 (all trade name of products from Kuraray Ltd.). The amount of coated poly(vinyl alcohol) (per 1 $m^2$ of support) in the surface protective layer (per one layer) is preferably in a range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

Further, it is preferred to use a lubricant such as a liquid paraffin, an aliphatic ester, or the like in the surface protective layer. The addition amount of the lubricant is in a range of from 1 $mg/m^2$ to 200 $mg/m^2$, preferably from 10 $mg/m^2$ to 150 $mg/m^2$, and more preferably from 20 $mg/m^2$ to 100 $mg/m^2$.

2) Antihalation Layer

The photothermographic material of the present invention can comprise an antihalation layer provided to the side farther from the light source with respect to the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two or more types of thermal bleaching dyes may be used in combination in a photothermographic material. Similarly, two or more types of base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone, 2-naphthylbenzoate, or the like) as disclosed in JP-A No. 11-352626.

3) Matting Agent

A matting agent is preferably added to the photothermographic material of the invention in order to improve transportability. Description on the matting agent can be found in paragraphs Nos. 0126 to 0127 of JP-A No.11-65021. The addition amount of the matting agent is preferably in a range from 1 $mg/m^2$ to 400 $mg/m^2$, and more preferably, from 5 $mg/m^2$ to 300 $mg/m^2$, with respect to the coating amount per 1 $m^2$ of the photothermographic material.

The shape of the matting agent usable in the invention may fixed form or non-fixed form. Preferred is to use those having fixed form and globular shape.

Volume weighted mean equivalent spherical diameter of the matting agent used in the image forming layer surface is preferably in a range of from 0.3 μm to 10 μm, and more preferably, from 0.5 μm to 7 μm. Further, the particle distribution of the matting agent is preferably set as such that the variation coefficient becomes from 5% to 80%, and more preferably, from 20% to 80%. The variation coefficient, herein, is defined by (the standard deviation of particle diameter)/(mean diameter of the particle)×100. Furthermore, two or more types of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in a range of from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more types of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The level of matting on the image forming layer surface is not restricted as far as star-dust trouble occurs, but the level of matting of from 30 seconds to 2000 seconds is preferred, particularly preferred, from 40 seconds to 1500 seconds as Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more, when expressed by Beck's smoothness.

In the present invention, a matting agent is preferably contained in an outermost layer, in a layer which can function as an outermost layer, or in a layer nearer to outer surface, and also preferably is contained in a layer which can function as a so-called protective layer.

4) Polymer Latex

The non-photosensitive layer of the photothermographic material according to the present invention preferably contains a polymer latex. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like. Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably from 20% by weight to 80% by weight, based on a total weight of binder.

5) Surface pH

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

6) Hardener

A hardener may be used in each of image forming layer, protective layer, back layer, and the like of the invention.

As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

7) Surfactant

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411, 2003-57780, and 2001-264110 are preferably used. Especially, the usage of the fluorocarbon surfactants described in JP-A Nos. 2003-57780 and 2001-264110 in an aqueous coating solution is preferred viewed from the standpoint of capacity in static control, stability of the coated surface state and sliding facility. The fluorocarbon surfactant described in JP-A No. 2001-264110 is most preferred because of high capacity in static control and that it needs small amount to use.

According to the invention, the fluorocarbon surfactant can be used on either side of both sides of the support, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably, for each of the image forming layer side and the back side, in a range of from 0.1 $mg/m^2$ to 100 $mg/m^2$, more preferably from 0.3 $mg/m^2$ to 30 $mg/m^2$, and even more preferably from 1 $mg/m^2$ to 10 $mg/m^2$. Especially, the fluorocarbon surfactant described in JP-A No. 2001-264110 is effective, and used preferably in a range of from 0.01 $mg/m^2$ to 10 $mg/m^2$, and more preferably, in a range of from 0.1 $mg/m^2$ to 5 $mg/m^2$.

8) Antistatic Agent

The photothermographic material of the invention preferably contains an electrically conductive layer including metal oxides or electrically conductive polymers. The antistatic layer may serve as an undercoat layer, a surface protective layer, or the like, but can also be placed specially.

As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably in a range of from 3.0 to 50, is preferred viewed from the standpoint of the electric conductivity effect. The metal oxides is preferably used in a range of from 1 $mg/m^2$ to 1000 $mg/m^2$, more preferably from 10 $mg/m^2$ to 500 $mg/m^2$, and even more preferably from 20 $mg/m^2$ to 200 $mg/m^2$.

The antistatic layer can be laid at any layer position, but it is preferred to set as an undercoat layer of the support or adjacent to the undercoat layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

9) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower when coating for an image forming layer or a back layer is conducted on the support.

10) Other Additives

Furthermore, an antioxidant, stabilizing agent, plasticizer, UV absorbing agent, or film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

11) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 10001 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of mono-sheet type (i.e., a type which can form image on the photothermographic material without using other sheets such as an image-receiving material).

12) Wrapping Material

In order to suppress fluctuation from occurring on photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

13) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, and 2001-348546.

(Image Forming Method)

The photothermographic material of the present invention is preferably a "double-sided type" having the image forming layer on both sides of the support.

1) Imagewise Exposure

The photothermographic material of the invention may be subjected to imagewise exposure by any methods.

As one embodiment, the photothermographic material of the present invention is preferably subjected to scanning exposure using a laser beam. As preferred laser beam which can be used in the invention, He—Ne laser of red through infrared emission, red laser diode, or $Ar^+$, He—Ne, He—Cd laser of blue through green emission, or blue laser diode are described. Preferred is red to infrared laser diode and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

As another embodiment, the photothermographic material of the present invention is preferably subjected to imagewise exposure with X-rays using a fluorescent intensifying screen.

The image forming method using these photothermographic materials comprises:

(i) bringing the above-described photothermographic material into contact with a fluorescent intensifying screen;

(ii) imagewise exposing the photothermographic material with X-rays to record a latent image on the photothermographic material; and (iii) thermally developing the photothermographic material to convert the latent image into a visible image by thermal development.

The photothermographic material used for the assembly in the present invention is subjected to X-ray exposure through a step wedge tablet and thermal development. On the photographic characteristic curve having an optical density (D) and an exposure value (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0.

For the X-ray radiography employed in the practice of the present invention, the use of photothermographic material having the aforesaid photographic characteristic curve would give the radiation images with excellent photographic properties that exhibit an extended bottom portion and high gamma value at a middle density area. According to this photographic property, the photographic properties mentioned have the advantage of that the depiction in a low density portion on the mediastinal region and the heart shadow region having little X-ray transmittance becomes excellent, and that the density becomes easy to view, and that gradation in the images on the lung field region having much X-ray transmittance becomes excellent.

The photothermographic material having a preferred photographic characteristic curve mentioned above can be easily prepared, for example, by the method where each of the image forming layer of both sides may be constituted of two or more image forming layers containing silver halide and having a sensitivity different from one another.

Especially, the aforesaid image forming layer preferably comprises an emulsion of high sensitivity for the upper layer and an emulsion with photographic properties of low sensitivity and high gradation for the lower layer.

In the case of preparing the image forming layer comprising two layers, the sensitivity difference between the silver halide emulsion in each layer is preferably from 1.5 times to 20 times, and more preferably from 2 times to 15 times.

The ratio of the amounts of emulsion used for forming each layer depends on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in a range of from 1:20 to 1:50 based on a silver amount.

As the techniques for crossover cutting (in the case of double-sided photosensitive material) and anti-halation (in the case of single-sided photosensitive material), dyes or combined use of dye and mordant described in JP-A. No. 2-68539, (from page 13, left lower column, line 1 to page 14, left lower column, line 9) can be employed.

<Fluorescent Intensifying Screen>

Next, a description of the fluorescent intensifying screen of the present invention will be given. The fluorescent intensifying screen essentially comprises a support and a fluorescent substance layer coated on one side of the support as the fundamental structure. The fluorescent substance layer is a layer where the fluorescent substance is dispersed in a binder. On the surface of a fluorescent substance layer opposite to the support side (the surface of the side that does not face on the support), a transparent protective layer is generally disposed to protect the fluorescent substance layer from chemical degradation and physical shock.

The fluorescent intensifying screen for X-rays which is more preferred for the present invention is a screen where 50% or more of the emission light has a wavelength region from 350 nm to 420 nm. Especially, as the fluorescent substance, a divalent europium activated fluorescent substance is preferred, and a divalent europium activated barium halide fluorescent substance is more preferred. The emission wavelength region is preferably from 360 nm to 420 nm, and more preferably from 370 nm to 420 nm. Moreover, the preferred fluorescent screen can emit 70% or more of the above region, and more preferably 85% or more thereof.

The ratio of the emission light can be calculated from the following method; the emission spectrum is measured where an antilogarithm of the emission wavelength is plotted on the abscissa axis at equal interval and a number of the emitted photon is plotted on the ordinate. The ratio of the emission light in the wavelength region from 350 nm to 420 nm is defined as a value dividing the area from 350 nm to 420 nm on the chart by the entire area of the emission spectrum. The photothermographic materials of the present invention used in combination with the fluorescent substance emitting the above wavelength region can attain high sensitivity.

In order that most of the emission light of the fluorescent substance may exist in the above wavelength region, the narrower half band width is preferred. The preferred half band width is from 1 nm to 70 nm, more preferably from 5 nm to 50 nm, and even more preferably from 10 nm to 40 nm.

As far as the fluorescent substance has the above emission, the fluorescent substance used in the present invention is not particularly limited, but the europium activated fluorescent substance where the divalent europium is an emission center is preferred to attain high sensitivity as the purpose of the invention. Specific examples of these fluorescent substances are described below, but the scope of the present invention is not limited to the examples.

BaFCl:Eu, BaFBr:Eu, BaFI:Eu, and the fluorescent substances where their halogen composition is changed; $BaSO_4$:Eu, SrFBr:Eu, SrFCl:Eu, SrFI:Eu, $(Sr,Ba)Al_2Si_2O_8$:Eu, $SrB_4O_7F$:Eu, $SrMgP_2O_7$:Eu, $Sr_3(PO_4)_2$:Eu, $Sr_2P_2O_7$:Eu, and the like.

More preferred fluorescent substance is a divalent europium activated barium halide fluorescent substance expressed by the following formula:

$$MX_1X_2:Eu$$

wherein, M represents Ba as a main component, but a small amount of Mg, Ca, Sr, or other compounds may be included. $X_1$ and $X_2$ each represent a halogen atom, and can be selected from F, Cl, Br, or I.

Herein, $X_1$ is more preferably a fluorine atom. $X_2$ can be selected from Cl, Br, or I, and the mixture with other halogen composition can be used preferably. More preferably, $X_2$ is Br. Eu represents an europium atom. Eu as an emission center is preferably contained at a ratio from $10^{-7}$ to 0.1, based on Ba, more preferably from $10^{-4}$ to 0.05. Preferably the mixture with a small quantity of other compounds can be included. As most preferred fluorescent substance, BaFCl:Eu, BaFBr:Eu, and $BaFBr_{1-x}I_x$:Eu can be described.

The fluorescent intensifying screen preferably consists of a support, an undercoat layer on the support, a fluorescent substance layer, and a surface protective layer.

The fluorescent substance layer is prepared as follows. A dispersion solution is prepared by dispersing the fluorescent substance particles described above in an organic solvent solution containing binder resins. The thus-prepared solution is coated directly on the support (or on the undercoat layer such as a light reflective layer provided beforehand on the support) and dried to form the fluorescent substance layer. Besides the above method, the fluorescent substance layer may be formed by the steps of coating the above dispersion solution on the temporary support, drying the coated dispersion to form a fluorescent substance layer sheet, peeling off the sheet from the temporary support, and fixing the sheet onto a permanent support by means of an adhesive agent.

The particle size of the fluorescent substance particles used in the present invention is not particularly restricted, but is usually in a range of from about 1 μm to 15 μm, and preferably from about 2 μm to 10 μm. The higher volume filling factor of the fluorescent substance particles in the fluorescent substance layer is preferred, usually in the range of from 60% to 85%, preferably from 65% to 80%, and particularly preferably from 68% to 75%. (The ratio of the fluorescent substance particles in the fluorescent substance layer is usually 80% by weight or more, preferably 90% by weight or more, and particularly preferably 95% by weight or more). Various known documents have described the binder resins, organic solvents, and the various additives used for forming the fluorescent substance layer. The thickness of the fluorescent substance layer may be set arbitrary according to the target sensitivity, but is preferably in a range of from 70 μm to 150 μm for the front side screen, and in a range of from 80 μm to 400 μm for the backside screen. The X-ray absorption efficiency of the fluorescent substance layer depends on the coating amount of the fluorescent substance particles in the fluorescent substance layer.

The fluorescent substance layer may consist of one layer, or may consist of two or more layers. It preferably consists of one to three layers, and more preferably, one or two layers. For example, the layer may be prepared by coating a plurality of layers comprising the fluorescent substance particles with different particle size having a comparatively narrow particle size distribution. In that case, the particle size of the fluorescent substance particles contained in each layer may gradually decrease from the top layer to the bottom layer provided next to the support. Especially, the fluorescent substance particles having a large particle size are preferably coated at the side of the surface protective layer and fluorescent substance particles having a small particle size are preferably coated at the side of the support. Hereto, the small particle size of fluorescent substance is preferably in a range of from 0.5 μm to 2.0 μm and the large size is preferably in a range of from 10 μm to 30 μm.

The fluorescent substance layer may be formed by mixing the fluorescent substance particles with different particle sizes, or the fluorescent substances may be packed in a particle size graded structure as described in JP-A No. 55-33560 (page 3, line 3 on the left column to page 4, line 39 on the left column). Usually, a variation coefficient of a particle size distribution of the fluorescent substance is in a range of from 30% to 50%, but monodispersed fluorescent substance particles with a variation coefficient of 30% or less can also be preferably used.

Attempts to attain a desired sharpness by dying the fluorescent substance layer with respect to the emission light wavelength are practiced. However, the layer with least dying is preferably required. The absorption length of the fluorescent substance layer is preferably 100 μm or more, and more preferably 1000 μm or more.

The scattering length of the fluorescent substance layer is preferably designed to be from 0.1 μm to 100 μm, and more preferably from 1 μm to 100 μm. The scattering length and the absorption length can be calculated from the equation based on the theory of Kubelka-Munk mentioned below.

Concerning the support, any support can be selected from various kinds of supports used in the well-known radiographic intensifying screen depending on the purpose. For example, a polymer film containing white pigments such as titanium dioxide or the like, and a polymer film containing black pigments such as carbon black or the like may be preferably used. An undercoat layer such as a light reflective layer containing a light reflective agent may be preferably coated on the surface of the support (the surface of the fluorescent substance layer side). The light reflective layer as described in JP-A No. 2001-124898 may be preferably used. Especially, the light reflective layer containing yttrium oxide described in Example 1 of the above patent or the light reflective layer described in Example 4 thereof is preferred. As for the preferred light reflective layer, the description in JP-A No. 23001-124898 (paragraph 3, 15 line on the right side to paragraph 4, line 23 on the right side) can be referred.

A surface protective layer is preferably coated on the surface of the fluorescent substance layer. The light scattering length measured at the main emission wavelength of the fluorescent substance is preferably in a range of from 5 μm to 80 μm, and more preferably from 10 μm to 70 μm, and particularly preferably from 10 μm to 60 μm. The light scattering length indicates a mean distance in which a light travels straight until it is scattered. Therefore a short scattering length means that the light scattering efficiency is high. On the other hand, the light absorption length, which indicates a mean free distance until a light is absorbed, is optional. From the viewpoint of the screen sensitivity, no absorption by the surface protective layer favors preventing the desensitization. In order to compensate the scattering loss, a very slightly absorption may be allowable. A preferred absorption length is 800 μm or more, and more preferably 1200 μm or more. The light scattering length and the light absorption length can be calculated from the equation based on the theory of Kubelka-Munk using the measured data obtained by the following method.

Three or more film samples comprising the same component composition as the surface protective layer of the aimed sample but a different thickness from each other are prepared, and then the thickness (μm) and the diffuse transmittance (%) of each of the samples is measured. The diffuse transmittance can be measured by means of a conventional spectrophotometer equipped with an integrating sphere. For the measurement of the present invention, an automatic recording spectrophotometer (type U-3210, manufactured by Hitachi Ltd.) equipped with an integrating sphere of 150ϕ (150-0901) is used. The measuring wavelength must correspond to the wavelength of the main emission peak of the fluorescent substance in the fluorescent substance layer having the surface protective layer. Thereafter, the film thickness (μm) and the diffuse transmittance (%) obtained in the above measurement is introduced to the following equation (A) derived from the theoretical equation of Kubelka-Munk. For example, the equation (A) can be derived easily, under the boundary condition of the diffuse transmittance (%), from the equations 5·1·12 to 5·1·15 on page 403 described in "Keikotai Hando Bukku" (the Handbook of Fluorescent Substance) (edited by Keikotai Gakkai, published by Ohmsha Ltd. 1987).

$$T/100=4\beta/[(1+\beta)^2\cdot\exp(\alpha d)-(1-\beta)^2\cdot\exp(-\alpha d)] \quad \text{Equation (A)}$$

wherein, T represents a diffuse transmittance (%), d represents a film thickness (μm) and, α and β are defined by the following equation respectively.

$$\alpha=[K\cdot(K+2S)]^{1/2}$$

$$\beta=[K/(K+2S)]^{1/2}$$

T (diffuse transmittance: %) and d (film thickness: μm) measured from three or more film samples are introduced respectively to the equation (A), and thereby the value of K and S are determined to satisfy the equation (A). The scattering length (μm) and the absorption length (μm) are defined by 1/S and 1/K respectively.

The surface protective layer may preferably comprise light scattering particles dispersed in a resin material. The light refractive index of the light scattering particles is usually 1.6 or more, and more preferably 1.9 or more. The particle size of the light scattering particles is in a range of from 0.1 μm to 1.0 μm. Examples of the light scattering particles can include the fine particles of aluminum oxide, magnesium oxide, zinc oxide, zinc sulfide, titanium oxide, niobium oxide, barium sulfate, lead carbonate, silicon oxide, polymethyl methacrylate, styrene, and melamine.

The resin materials used to form the surface protective layer are not particularly limited, but poly(ethylene terephthalate), poly(ethylene naphthalate), polyamide, aramid, fluororesin, polyesters, or the like are preferably used. The surface protective layer can be formed by the step of dispersing the light scattering particles set forth above in an organic solvent solution containing the resin material (binder resin) to prepare a dispersion solution, coating the dispersion solution on the fluorescent substance layer directly (or via an optionally provided auxiliary layer), and then drying the coated solution. By other way, the surface protective sheets prepared separately can be overlaid on the fluorescent substance layer by means of an adhesive agent. The thickness of the surface protective layer is usually in a range of from 2 μm to 12 μm, and preferably from 3.5 μm to 10 μm.

In addition, in respect with the preferred producing methods and the materials used for the process of the radiographic intensifying screen, references can be made to various publications, for example, JP-A No. 9-21899 (page 6, line 47 on left column to page 8, line 5 on left column), JP-A No. 6-347598 (page 2, line 17 on right column to page 3, line 33 on left column) and (page 3, line 42 on left column to page 4, line 22 on left column).

In the fluorescent intensifying sheets used for the present invention, the fluorescent substance is preferably packed in a particle size graded structure. Especially, the fluorescent substance particles having a large particle size are preferably coated at the side of the surface protective layer and fluorescent substance particles having a small particle size are preferably coated at the side of the support. The small particle size of fluorescent substance is preferably in a range of from 0.5 μm to 2.0 μm, and the large size is preferably in a range of from 10 μm to 30 μm.

Concerning the image forming method using photothermographic material according to the present invention, it is preferred that the image forming method is performed in combination with a fluorescent substance having a main emission peak at 400 nm or lower. And more preferably, the image forming method is performed in combination with a fluorescent substance having a main emission peak at 380 nm or lower. Either single-sided photosensitive material or double-sided photosensitive material can be applied for the assembly. As the screen having a main emission peak at 400 nm or lower, the screens described in JP-A No. 6-11804 and WO No. 93/01521 and the like are used, but the present invention is not limited to these. As the techniques of cross-over cutting (for double-sided photosensitive material) and anti-halation (for single-sided photosensitive material) of ultraviolet light, the technique described in JP-A No. 8-76307 can be applied. As ultraviolet absorbing dyes, the dye described in JP-A No. 2001-144030 is particularly preferred.

2) Thermal Development

Although any method may be used for developing the photothermographic material of the present invention, development is usually performed by elevating the temperature of the photothermographic material exposed imagewise. The temperature of development is preferably from 80° C. to 250° C., and more preferably from 100° C. to 140° C. Time period for development is preferably from 1 second to 60 seconds, more preferably from 5 second to 30 seconds, and even more preferably from 5 seconds to 20 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C.

For thermally developing the double-sided photothermographic material, it is preferred that plural heating means are disposed separately in a back to back relation with one another along a conveying route of the photothermographic material to heat both surfaces of the photothermographic material.

Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

(Application of the Invention)

The photothermographic material of the invention is preferably used for photothermographic materials for use in medical diagnosis, through forming black and white images by silver imaging.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

1. Preparation of PET Support (1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

(2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

(3) Undercoating

<<Preparations of Coating Solution for Undercoat Layer>>

| Formula (1) (for undercoat layer on the image forming layer side) | |
|---|---|
| Pesresin A-520 manufactured by Takamatsu Oil & Fat Co., Ltd. (30% by weight solution) | 59 g |
| Polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| Distilled water | 935 mL |
| **Formula (2) (for first layer on the backside)** | |
| Styrene-butadiene copolymer latex (solid content of 40% by weight, styrene/butadiene mass ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| **Formula (3) (for second layer on the backside)** | |
| $SnO_2$/SbO (9/1 mass ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |

-continued

| | |
|---|---|
| Proxel (manufactured by Imperial Chemical Industries PLC) | 1 mL |
| Distilled water | 805 mL |

<<Undercoating>>

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 7.7 mL/m$^2$, and dried at 180° C. for 6 minutes. Thus, an undercoated support was produced.

2. Back Layer

1) Preparation of Coating Solution for Antihalation Layer

<Preparation of Dispersion of Solid Fine Particles (a) of Base Precursor>

2.5 kg of base precursor-1, 300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion included feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. Thus resulting dispersion was diluted with distilled water so that the concentration of the base precursor became 25% by weight, and filtrated (with a polypropylene filter having a mean fine pore diameter of 3 μm) for eliminating dust to put into practical use.

<Preparation of Solid Fine Particle Dispersion of Dye>

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. Thus resulting dispersion was diluted with distilled water so that the concentration of the cyanine dye became 6% by weight, and filtrated with a filter (mean fine pore diameter: 1 μm) for removing dust to put into practical use.

<Preparation of Coating Solution for Antihalation Layer>

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone, and 490 mL of water to allow gelatin to be dissolved. Additionally, 2.3 mL of a 1 mol/L sodium hydroxide aqueous solution, 40 g of the above-mentioned dispersion of the solid fine particles of the dye, 90 g of the above-mentioned dispersion of the solid fine particles (a) of the base precursor, 12 mL of a 3% by weight aqueous solution of sodium polystyrenesulfonate, and 180 g of a 10% by weight liquid of SBR latex were admixed. Just prior to the coating, 80 mL of a 4% by weight aqueous solution of N,N-ethylenebis(vinylsulfone acetamide) was admixed to give a coating solution for the antihalation layer.

2) Preparation of Coating Solution for Back Surface Protective Layer

A vessel was kept at 40° C., and thereto were added 40 g of gelatin, 35 mg of benzoisothiazolinone, and 840 mL of water to allow gelatin to be dissolved. Additionally, 5.8 mL of a 1 mol/L sodium hydroxide aqueous solution, 5 g of a 10% by weight emulsion of liquid paraffin, 5 g of a 10% by weight emulsion of tri(isostearic acid)-trimethylol-propane, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight liquid of methyl methacrylate/styrene/butyl acrylatel hydroxyethyl methacrylate/acrylic acid copolymer (mass ratio of the copolymerization of 57/8/28/5/2) latex were admixed. Just prior to the coating, 25 mL of a 4% by weight aqueous solution of N,N-ethylenebis (vinylsulfone acetamide) was admixed to give a coating solution for the back surface protective layer.

3) Coating of Back Layer

The backside of the undercoated support described above was subjected to simultaneous double coating so that the coating solution for the antihalation layer gave the coating amount of gelatin of 0.52 g/m$^2$, and so that the coating solution for the back surface protective layer gave the coating amount of gelatin of 1.7 g/m$^2$, followed by drying to produce a back layer.

3. Image Forming Layer, Intermediate Layer, and Surface Protective Layer 3-1. Preparations of Coating Material 1) Preparation of Silver Halide Emulsion <<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazolin-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $5.0\times10^{-4}$ mol per 1 mol of silver, 1-phenyl-2-heptyl-5-mercapto-1,3,4-triazole in a methanol solution at $5.0\times10^{-4}$ mol per 1 mol of silver, and 1-(3-methylureidophenyl)-5-mercaptotetrazole in an aqueous solution at $8.5\times10^{-4}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide dispersion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion 2 similar to the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide dispersion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: to the silver halide dispersion 3, the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparations of Mixed Emulsion A1 to A8 for Coating Solution>>

The silver halide emulsion 1 at 70% by weight, the silver halide emulsion 2 at 15% by weight, and the silver halide emulsion 3 at 15% by weight were warmed and dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution. The liquid was kept at 40° C., and thereto was added the compound represented by formula (I) according to the present invention or the comparative compound as shown in Table 1, and stirred for 20 minutes. The compound represented by formula (I) according to the present invention was dissolved in methanol and was added as a 0.02 mol/L methanol solution. The silver salt of an acetylene compound was added as a dispersion prepared by the method described below.

Thereafter, as "a compound that is one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Comparative compound A

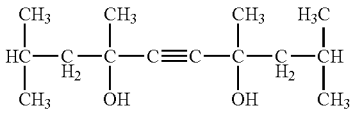

Comparative compound B

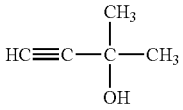

<<Preparation of Comparative Silver Salt of Acetylene Compound>>

An emulsion of silver salt of 4-acetylaminophenyl acetylene was prepared by the method described in the Example 1 of JP-A No. 63-217347.

2) Preparation of Dispersion of Silver Salt of Fatty Acid

<<Preparation of Recrystallized Behenic Acid>>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<<Preparation of Dispersion of Silver Salt of Fatty Acid>>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Dispersion of Silver Salt of Benzotriazole

A dispersion of silver salt of benzotriazole was prepared by the method described in the Example 1 of JP-A No. 63-217347.

4) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion.

Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less. The resultant reducing agent dispersion was subjected to filtration with a polypropylene filter having a pore size of 3.0 μm to remove foreign substances such as dust, and stored.

5) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

6) Preparations of Development Accelerator Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resultant development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of other development accelerator, dispersion was executed similar to the development accelerator-1, and thus dispersions of 20% by weight were obtained.

7) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained.

Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparations of Binder Latex Liquid

<<Preparation of SBR Latex Liquid>>

SBR latex (TP-1) was prepared as follows.

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex (TP-1) was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, an ionic conductance of 4.80 mS/cm (measurement of the ionic conductance was performed using a conductivity meter CM-30S manufactured by Toa Electronics Ltd. for the latex stock solution (44% by weight) at 25° C.), and the pH of 8.4.

<<Preparation of Isoprene Latex Liquid>>

Isoprene latex (TP-2) was prepared as follows.

1500 g of distilled water were poured into the polymerization vessel of a gas monomer reaction apparatus (type TAS-2J manufactured by Tiatsu Garasu Kogyo Ltd.), and the vessel was heated for 3 hours at 90° C. to make passive film over the stainless vessel surface and stainless stirring device. Thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercaptan were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then, the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, the resulting mixture was filtered with a polypropylene filter having a pore size of 1.0 μm to remove foreign substances such as dust, and stored. 1248 g of isoprene latex (TP-2) was obtained. The measurement of halogen ion by an ion chromatography showed that the concentration of residual chloride ion was 3 ppm. The measurement by a high speed liquid chromatography showed that residual chelating agent concentration was 142 ppm.

The obtained latex has an average particle size of 113 nm, Tg=15° C., a solid content of 41.3% by weight, an equilibrium moisture content under the atmosphere of 25° C. and 60RH % of 0.4% by weight, and an ionic conductivity of 5.23 mS/cm (the measurement of which was carried out at 25° C. using a conductometer CM-30S produced by DKK-TOA Corp.).

3-2. Preparations of Coating Solution

1) Preparation of Coating Solution for Image Forming Layer

To the dispersion of the silver salt of a fatty acid obtained as described above in an amount of 1000 g were serially added water, the organic polyhalogen compound-1 dispersion, the organic polyhalogen compound-2 dispersion, the SBR latex (TP-1) liquid, the isoprene latex (TP-2) liquid, the phthalazine compound-1 solution, the reducing agent-1 dispersion, the reducing agent-2 dispersion, the hydrogen bonding compound-1 dispersion, the development accelerator dispersion (shown in Table 1), the mercapto compound-1 aqueous solution, the mercapto compound-2 aqueous solution. Just prior to the coating, the mixed emulsion for coating solution was added thereto, followed by thorough mixing just prior to the coating, which was fed directly to a coating die.

Further, a coating solution shown in Table 1 was prepared similarly except that, instead of using the dispersion of the silver salt of a fatty acid, the dispersion of the silver salt of benzotriazole obtained as described above in the same amount based on silver amount was used.

2) Preparations of Coating Solution for Intermediate Layer

To 1000 g of poly(vinyl alcohol) PVA-205 (manufactured by Kuraray Co., Ltd.), 27 mL of a 5% by weight aqueous solution of sodium di(2-ethylhexyl)sulfosuccinate, and 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 8.9 $mL/m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In 800 mL of water were dissolved 100 g of inert gelatin and 10 mg of benzoisothiazolinone, and thereto were added liquid paraffin emulsion at 8.0 g equivalent to liquid paraffin, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl) sulfosuccinate, 4 g of poly(methyl methacrylate) fine particles (mean particle diameter of 0.7 μm), and 21 g of poly(methyl methacrylate) fine particles (mean particle diameter of 4.5 μm), and the obtained mixture was mixed to give a coating solution for the surface protective layer, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

4. Preparations of Photothermographic Material

1) Preparations of Photothermographic Material-1-1 to 1-15

Simultaneous overlaying coating by a slide bead coating method was subjected in order of the image forming layer, intermediate layer, first layer of the surface protective layers, and second layer of the surface protective layers, starting from the undercoated face. Thus samples of photothermographic material were produced. In this method, the temperature of the coating solution was adjusted to 31° C. for the image forming layer and intermediate layer, to 36° C. for the first layer of the surface protective layers, and to 37° C. for the second layer of the surface protective layers.

TABLE 1

| | | Compound of Formula(I) | | | Development Accelerator | | Photographic Properties | | Raw Stock Storability | | |
|---|---|---|---|---|---|---|---|---|---|---|---|
| Sample No. | Mixed Emulsion No. | Compound No. | Addition Amount (mol % vs. silver halide) | Non-photosensitive Silver Salt | No. | Addition Amount (mol/m$^2$) | Fog | Sesitivity (S) | Δ Fog | Sesitivity (Δ S) | Note |
| 1-1 | A1 | — | — | Silver salt of a fatty acid | No. 1/No. 2 | 0.019/0.016 | 0.18 | 100 | 0.015 | 110 | Comparative |
| 1-2 | A1 | — | — | Silver salt of a fatty acid | No. 1/No. 2 | 0.025/0.021 | 0.19 | 126 | 0.025 | 110 | Comparative |
| 1-3 | A1 | — | — | Silver salt of a fatty acid | No. 1/No. 2 | 0.030/0.026 | 0.20 | 158 | 0.035 | 110 | Comparative |
| 1-4 | A2 | Comparative compound A | $4.0 \times 10^{-2}$ | Silver salt of a fatty acid | No. 1/No. 2 | 0.019/0.016 | 0.30 | 110 | 0.250 | 120 | Comparative |
| 1-5 | A3 | Comparative compound B | $4.0 \times 10^{-2}$ | Silver salt of a fatty acid | No. 1/No. 2 | 0.019/0.016 | 0.25 | 120 | 0.300 | 126 | Comparative |
| 1-6 | A1 | — | — | Silver salt of benzotriazole | No. 1/No. 2 | 0.019/0.016 | No image is obtained | | | | Comparative |
| 1-7 | A4 | Silver salt of 4-acetyl-aminophenyl acetylene | $1.0 \times 10^{-4}$ | Silver salt of benzotriazole | No. 1/No. 2 | 0.019/0.016 | No image is obtained | | | | Comparative |
| 1-8 | A5 | No. 26 | $1.0 \times 10^{-4}$ | Silver salt of benzotriazole | No. 1/No. 2 | 0.019/0.016 | No image is obtained | | | | Comparative |
| 1-9 | A5 | No. 26 | $1.0 \times 10^{-4}$ | Silver salt of a fatty acid | No. 1/No. 2 | 0.030/0.025 | 0.10 | 126 | 0.028 | 105 | Invention |
| 1-10 | A6 | No. 51 | $1.0 \times 10^{-4}$ | Silver salt of a fatty acid | No. 1/No. 2 | 0.030/0.026 | 0.08 | 120 | 0.020 | 108 | Invention |
| 1-11 | A7 | No. 52 | $1.0 \times 10^{-4}$ | Silver salt of a fatty acid | No. 1/No. 2 | 0.019/0.016 | 0.04 | 94 | 0.005 | 100 | Invention |
| 1-12 | A7 | No. 52 | $1.0 \times 10^{-4}$ | Silver salt of a fatty acid | No. 1/No. 2 | 0.025/0.021 | 0.04 | 111 | 0.006 | 105 | Invention |
| 1-13 | A7 | No. 52 | $1.0 \times 10^{-4}$ | Silver salt of a fatty acid | No. 1/No. 2 | 0.030/0.026 | 0.05 | 143 | 0.008 | 110 | Invention |
| 1-14 | A8 | No. 2 | $1.0 \times 10^{-4}$ | Silver salt of a fatty acid | No. 1/No. 2 | 0.030/0.026 | 0.06 | 135 | 0.008 | 110 | Invention |
| 1-15 | A8 | No. 2 | $1.0 \times 10^{-3}$ | Silver salt of a fatty acid | No. 1/No. 2 | 0.030/0.026 | 0.03 | 128 | 0.004 | 102 | Invention |

The coating amount of each compound (g/m$^2$) for the image forming layer is as follows.

| | |
|---|---|
| Silver salt of a fatty acid | 5.42 |
| Organic polyhalogen compound-1 | 0.12 |
| Organic polyhalogen compound-2 | 0.25 |
| Compound of formula (I) of the invention or | (see Table 1) |

-continued

| | |
|---|---|
| comparative compound | |
| Phthalazine compound-1 | 0.18 |
| SBR latex (TP-1) | 2.83 |
| Isoprene latex (TP-2) | 6.60 |
| Reducing agent-1 | 0.40 |
| Reducing agent-2 | 0.40 |
| Hydrogen bonding compound-1 | 0.58 |
| Development accelerator | (see Table 1) |
| Mercapto compound-1 | 0.002 |
| Mercapto compound-2 | 0.012 |
| Silver halide (on the basis of Ag content) | 0.10 |

Conditions for coating and drying are as follows.

Coating was performed at the speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the back surface as Beck's smoothness. In addition, measurement of pH of the film surface on the image forming layer side gave the result of 6.0.

Chemical structures of the compounds used in Examples of the invention are shown below.

Spectral sensitizing dye A

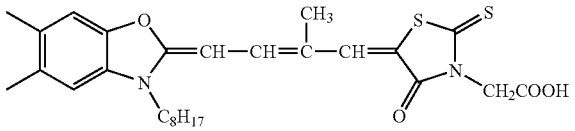

Spectral sensitizing dye B

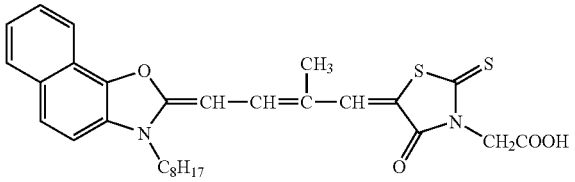

Tellurium sensitizer C

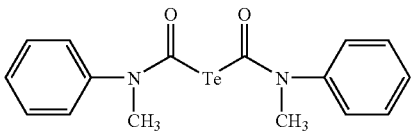

-continued

Base precursor-1

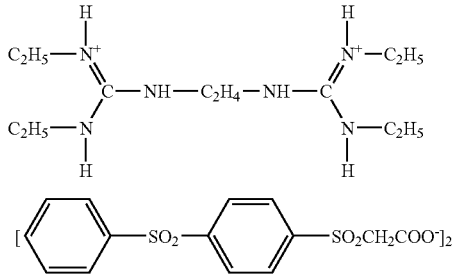

Cyanine dye-1

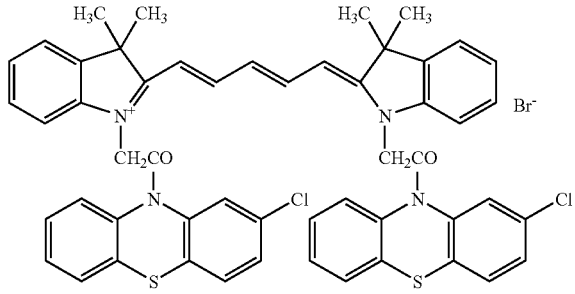

Compound 1 that is one-electron-oxidized to provide a one-electron oxidation product which releases one or more electrons

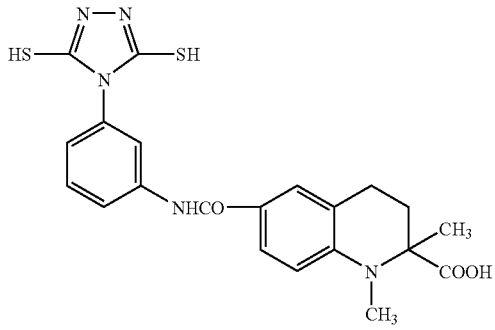

Compound 2 that is one-electron-oxidized to provide a one-electron oxidation product which releases one or more electrons

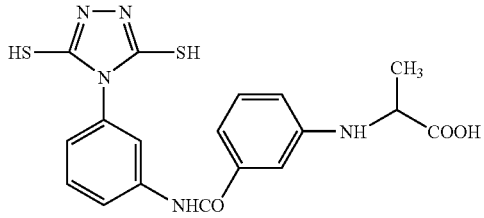

Compound 3 that is one-electron-oxidized to provide a one-electron oxidation product which releases one or more electrons

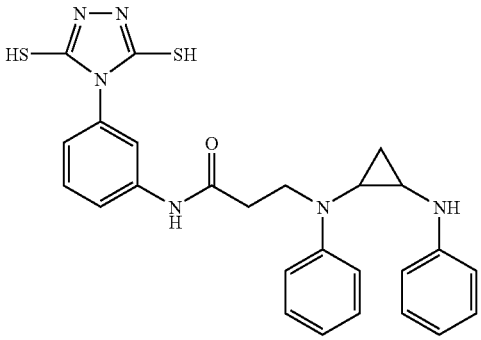
Reducing agent-1
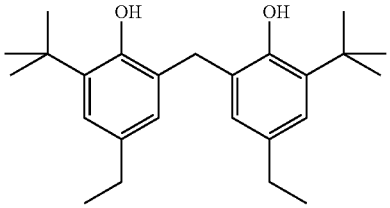
Reducing agent-2
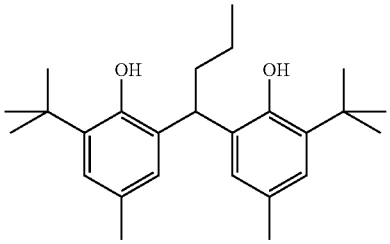
Hydrogen bonding compound-1
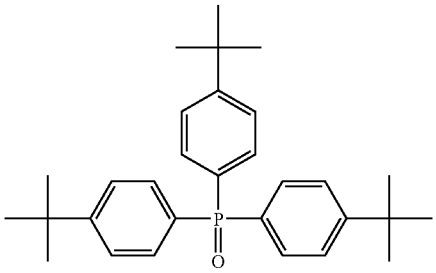
Organic polyhalogen compound-1
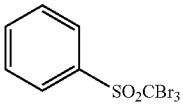
Organic polyhalogen compound-2
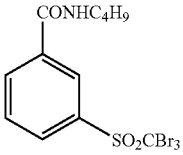
-continued
Mercapto compound-1
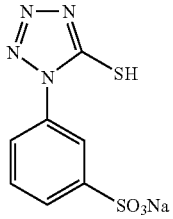
Mercapto compound-2
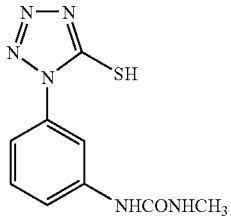
Phthalazine compound-1
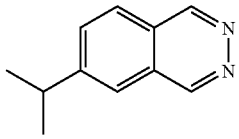
Development accelerator-1
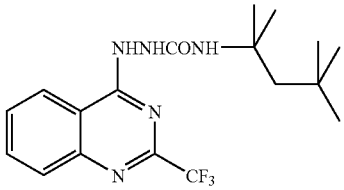
Development accelerator-2
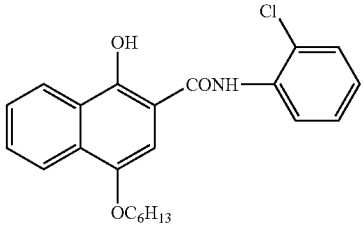
(F-1)
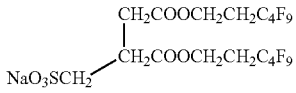
(F-2)
Mixture of
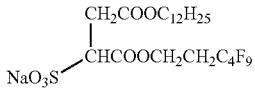
and
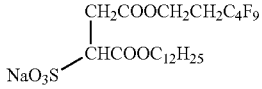

5. Evaluation of Photographic Properties

1) Preparation

The obtained sample was cut into a half-cut size and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.:0.02 $mL \cdot atm^{-1}m^{-2}day^{-1}$;

vapor permeability at 25° C.:0.10 $g \cdot atm^{-1}m^{-2}day^{-1}$.

2) Exposure and Thermal Development

To each sample, exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation on the obtained image was performed with a densitometer.

3) Evaluation of Performance

<<Photographic Properties>>

The photothermographic material prepared above was subjected to exposure by changing the exposure value of a laser beam step by step. The density of the image obtained after development was measured by a Macbeth densitometer. The photographic characteristic curve was prepared by plotting the density against the exposure value.

Fog: Fog is expressed in terms of a density of the part unexposed by laser.

Sensitivity (S): Sensitivity is expressed in terms of the inverse of the exposure value giving a density of fog+1.0. The sensitivities are shown in a relative value, detecting the sensitivity of a standard sample to be 100.

<<Raw Stock Storability >>

One part of the obtained sample was stored in a freezer and the other part was stored in a room temperature condition for one month. The sample stored in the freezer and the sample stored in the room temperature condition were subjected to the same photographic performance test as described above and evaluated about the fog change (Δ Fog) and the sensitivity change (Δ S) thereof.

Δ Fog=Fog (Fog of a sample stored at the room temperature)−Fog (Fog of a sample stored in the freezer)

Δ S=S (Sensitivity of a sample stored at the room temperature)−S (Sensitivity of a sample stored in the freezer)

<<Results>>

The obtained results are shown in Table 1.

The compound of the present invention can effectively depress the increase of fog while keeping the sensitivity loss to a minimum in comparison with the comparative compound. Moreover, it is found that the compound of the present invention has an effect to depress the increase of fog during storage while keeping the sensitivity change to a minimum. The above effect is extremely remarkable in a high sensitive system where the addition amount of the development accelerator is increased. In the case where the silver salt of benzotriazole is used as a comparative non-photosensitive organic silver salt in the present invention, the obtained image density is so low that the image can not be evaluated.

Example 2

1) Preparations of Photosensitive Silver Halide Emulsion

<<Preparation of Silver Halide Emulsion 4>>

Preparation of silver halide emulsion 4 was conducted in a similar manner to the process in the preparation of silver halide emulsion 1 of Example 1 except that, instead of ripening after the addition of tellurium sensitizer C, after elevating the temperature to 56° C., a methanol solution of triethyl thiourea was added in an amount of 0.1 mmol per 1 mol of silver, followed by ripening for 80 minutes, and thereafter the temperature was kept at 56° C. The shape of the obtained grains was similar to silver halide emulsion 1.

<<Preparation of Silver Halide Emulsion 5>>

Preparation of silver halide emulsion 5 was conducted in a similar manner to the process in the preparation of silver halide emulsion 2 of Example 1 except that, instead of ripening after the addition of tellurium sensitizer C, after elevating the temperature to 56° C., a methanol solution of triethyl thiourea was added in an amount of 0.2 mmol per 1 mol of silver, followed by ripening for 80 minutes, and thereafter the temperature was kept at 56° C. The shape of the obtained grains was similar to silver halide emulsion 2.

<<Preparation of Silver Halide Emulsion 6>>

Preparation of silver halide emulsion 6 was conducted in a similar manner to the process in the preparation of silver halide emulsion 3 of Example 1 except that, instead of ripening after the addition of tellurium sensitizer C, after elevating the temperature to 56° C., a methanol solution of triethyl thiourea was added in an amount of 0.085 mmol per 1 mol of silver, followed by ripening for 80 minutes, and thereafter the temperature was kept at 56° C. The shape of the obtained grains was similar to silver halide emulsion 3.

<<Preparation of Silver Halide Emulsion 7>>

Preparation of silver halide emulsion 7 was conducted in a similar manner to the process in the preparation of silver halide emulsion 4 described above except that: at 5 minutes after the addition of triethyl thiourea, an aqueous chloroauric acid solution and an aqueous potassium thiocyanate solution were added in an amount of 15.2 μmol and 1.9 mmol per 1 mol of silver, respectively. The shape of the obtained grains was similar to silver halide emulsion 4.

<<Preparation of Silver Halide Emulsion 8>>

Preparation of silver halide emulsion 8 was conducted in a similar manner to the process in the preparation of silver halide emulsion 5 described above except that: at 5 minutes after the addition of triethyl thiourea, an aqueous chloroauric acid solution and an aqueous potassium thiocyanate solution were added in an amount of 8.0 μmol and 1.0 mmol per 1 mol of silver, respectively. The shape of the obtained grains was similar to silver halide emulsion 5.

<<Preparation of Silver Halide Emulsion 9>>

Preparation of silver halide emulsion 9 was conducted in a similar manner to the process in the preparation of silver halide emulsion 6 described above except that: at 5 minutes after the addition of triethyl thiourea, an aqueous chloroauric acid solution and an aqueous potassium thiocyanate solution were added in an amount of 18.8 μmol and 2.4 mmol per 1 mol of silver, respectively. The shape of the obtained grains was similar to silver halide emulsion 6.

<<Preparations of Mixed Emulsion B1 to B5 for Coating Solution>>

Preparations of mixed emulsion B1 to B5 for a coating solution were conducted in a similar manner to the process in the preparation of the mixed emulsion for a coating solution of Example 1 except that silver halide emulsion 1, silver halide emulsion 2, and silver halide emulsion 3 were changed to silver halide emulsion 4, silver halide emulsion 5, and silver halide emulsion 6, respectively, and the compound represented by formula (1) was added as shown in Table 2.

<<Preparations of Mixed Emulsion C1 to C5 for Coating Solution>>

Preparations of mixed emulsion C1 to C5 for a coating solution were conducted in a similar manner to the process in the preparation of the mixed emulsion for a coating solution of Example 1 except that silver halide emulsion 1, silver halide emulsion 2, and silver halide emulsion 3 were changed to silver halide emulsion 7, silver halide emulsion 8, and silver halide emulsion 9, respectively, and the compound represented by formula (1) was added as shown in Table 2.

2) Preparations of Photothermographic Material

Sample Nos. 2-1 to 2-10 were prepared in a similar manner to the process in the preparation of sample No. 1-9 of Example 1 except that mixed emulsion for a coating solution was changed to the mixed emulsion B1 to B5 or C1 to C5 for a coating solution as described in Table 2.

3) Evaluation of Performance

Evaluation was performed similar to Example 1, and the obtained results are shown in Table 2. The sensitivities are shown in a relative value, detecting the sensitivity of a standard sample No. 1-1 of Example 1 to be 100. Samples of the present invention can depress the initial fog and the fog increase during storage while keeping the desensitization to a minimum, in the case where the chemical sensitization was carried out by sulfur sensitizer. Further, the sensitivity change during storage was also depressed.

As seen from the result obtained for sample No. 2-6, the emulsion subjected to gold-sulfur sensitization (gold-plus-sulfur sensitization) can increase the sensitivity, but presents problems such as high initial fog, and large increase in fog and sensitivity during storage. On the other hand, it can be seen apparently from the data obtained for samples Nos. 2-7 to 2-10 that these defects are effectively improved by using the compound of the present invention. That is to say, the photothermographic materials which exhibit excellent performances such as high sensitivity and low fog while keeping the fog increase and the sensitivity change during storage to a minimum can be attained.

TABLE 2

| Sample No. | Silver Halide Emulsion | Compound of Formula (I) Compound No. | Compound of Formula (I) Addition Amount (mol % vs. silver halide) | Photographic Properties Fog | Photographic Properties Sesitivity (S) | Raw Stock Storability Δ Fog | Raw Stock Storability Sensitivity (Δ S) | Note |
|---|---|---|---|---|---|---|---|---|
| 2-1 | B1 | — | — | 0.18 | 145 | 0.030 | 115 | Comparative |
| 2-2 | B2 | 26 | $1.0 \times 10^{-4}$ | 0.08 | 120 | 0.025 | 110 | Invention |
| 2-3 | B3 | 51 | $1.0 \times 10^{-4}$ | 0.08 | 120 | 0.022 | 110 | Invention |
| 2-4 | B4 | 52 | $1.0 \times 10^{-4}$ | 0.05 | 145 | 0.007 | 108 | Invention |
| 2-5 | B5 | 2 | $1.0 \times 10^{-4}$ | 0.05 | 140 | 0.007 | 112 | Invention |
| 2-6 | C1 | — | — | 0.35 | 430 | 0.065 | 128 | Comparative |
| 2-7 | C2 | 26 | $1.0 \times 10^{-4}$ | 0.12 | 415 | 0.030 | 115 | Invention |
| 2-8 | C3 | 51 | $1.0 \times 10^{-4}$ | 0.10 | 410 | 0.028 | 118 | Invention |
| 2-9 | C4 | 52 | $1.0 \times 10^{-4}$ | 0.05 | 425 | 0.009 | 105 | Invention |
| 2-10 | C5 | 2 | $1.0 \times 10^{-4}$ | 0.06 | 420 | 0.100 | 106 | Invention |

Example 3

1. Preparation of PET Support and Undercoating

The PET support having a thickness of 175 μm, which was prepared similar to Example 1, was subjected to the corona discharge treatment. Thereafter, the following undercoating was performed.

1) Preparation of Coating Solution for Undercoat Layer

| | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethylene glycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| Distilled water | 931 mL |

2) Undercoating

The aforementioned coating solution for the undercoat was coated on both surfaces of the aforementioned support with a wire bar so that the amount of wet coating became 6.6 mL/m$^2$ (per one side), and dried at 180° C. for 5 minutes. This was subjected on both sides, and thus, an undercoated support was produced.

2. Preparations of Coating Material

1) Preparation of Silver Halide Emulsion D

—Preparation of Host Grains—

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio) diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2.

Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2.

Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver.

The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

Thus, unripened pure silver iodide emulsion was prepared.

The obtained silver halide grains were grains having a mean projected area equivalent diameter of 0.93 μm, a variation coefficient of a projected area equivalent diameter distribution of 17.7%, a mean thickness of 0.057 μm, and a mean aspect ratio of 16.3. Tabular grains having an aspect ratio of 2 or more occupied 80% or more of the total projected area. A mean equivalent spherical diameter of the grains was 0.42 μm. 30% or more of the silver iodide existed in γ phase from the result of powder X-ray diffraction analysis.

—Preparation of Epitaxial Junction Portion—

1 mol of the unripened emulsion described above was added to a reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

—Chemical Sensitization—

The above silver halide emulsion having an epitaxial junction portion was kept at 38° C. with stirring, and to each was added 5 mL of a 0.34% by weight methanol solution of 1,2-benzoisothiazolin-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes.

Then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $5.0\times10^{-4}$ mol per 1 mol of silver, 1-phenyl-2-heptyl-5-mercapto-1,3,4-triazole in a methanol solution at $5.0\times10^{-4}$ mol per 1 mol of silver, and 1-(3-methylureido phenyl)-5-mercaptotetrazole in an aqueous solution at $8.5\times10^{-4}$ mol per 1 mol of silver were added.

<<Preparation of Emulsion for Coating Solution>>

The above-described silver halide emulsion was dissolved and thereto was added benzothiazolium iodide in a 1% by weight aqueous solution to give $7\times10^{-3}$ mol per 1 mol of silver. Further, as "a compound that is one-electron-oxidized to provide a one-electron oxidation product, which releases one or more electrons", the compounds Nos. 1, 2, and 3 are added respectively in an amount of $2\times10^{-3}$ mol per 1 mol of silver in silver halide.

Thereafter, as "a compound having an adsorptive group and a reducing group", the compound Nos. 1 and 2 are added respectively in an amount of $8\times10^{-3}$ mol per 1 mol of silver halide.

Further, water is added thereto to give the content of silver halide of 15.6 g in terms of silver, per 1 liter of the emulsion for a coating solution.

2) Preparation of Reducing Agent-3 Dispersion

To 10 kg of reducing agent-3 (1,1-bis(2-hydroxy-3,5-dimethylphenyl)-3,5,5-trimethylhexane) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to heat treatment at 60° C. for 5 hours to obtain reducing agent-3 dispersion.

Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

3) Preparation of Nucleator Dispersion 2.5 g of poly(vinyl alcohol) (manufactured by Kuraray Co., Ltd., PVA-217) and 87.5 g of water were added to 10 g of nucleator No. SH-7, and thoroughly admixed to give a slurry. This slurry was allowed to stand for 3 hours.

Zirconia beads having a mean particle diameter of 0.5 mm were provided in an amount of 240 g, and charged in a vessel with the slurry. Dispersion was performed with a dispersing machine (1/4G sand grinder mill: manufactured by AIMEX Co., Ltd.) for 10 hours to obtain a solid fine particle dispersion of nucleator. Particles of the nucleator included in the resulting nucleator dispersion had a mean particle diameter of 0.5 μm, and 80% by weight of the particles had a particle diameter of from 0.1 μm to 1.0 μm.

4) Preparation of Color-tone-adjusting Agent Dispersion 10 kg of color-tone-adjusting agent-1, 20 kg of a 10% by weight aqueous solution of modified poly(vinyl alcohol) (manufactured by Kuraray Co., Ltd., Poval MP203), and 10 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the color-tone-adjusting agent to be 20% by weight to obtain color-tone-adjusting agent-1 dispersion.

Particles of the color-tone-adjusting agent included in the resulting color-tone-adjusting agent dispersion had a median diameter of 0.48 μm, and a maximum particle diameter of 1.4 μm or less. The resultant color-tone-adjusting agent dispersion was subjected to filtration with a polypropylene filter having a pore size of 3.0 μm to remove foreign substances such as dust, and stored.

5) Preparation of Silver Iodide Complex-forming Agent Solution 8 kg of modified poly(vinyl alcohol) MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of 6-isopropylphthalazine. Accordingly, a 5% by weight solution of silver iodide complex-forming agent was prepared.

6) Preparations of Solution of Compound Represented by Formula (I) of the Invention Compound A to E were each dissolved in methanol to prepare 0.02 mol/L solutions.

Compound A

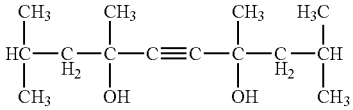

Compound B

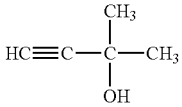

Compound C

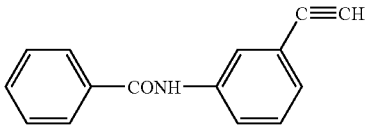

Compound D

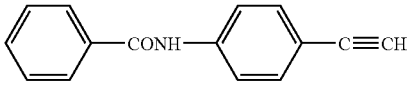

Compound E

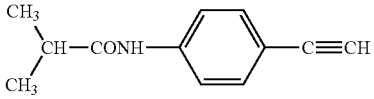

7) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain pigment-1 dispersion. Particles of the pigment included in the resulting pigment dispersion had a mean particle diameter of 0.21 μm.

3. Preparations of Coating Solution

1) Preparations of Coating Solution-11 to -16 for Image Forming Layer

To the dispersion of silver salt of a fatty acid obtained as described above in an amount of 1000 g were serially added water, the organic polyhalogen compound-1 dispersion, the organic polyhalogen compound-2 dispersion, the solution of the compound represented by formula (I) of the invention (shown in Table 3), the SBR latex (TP-1) liquid, the isoprene latex (TP-2) liquid, the reducing agent-3 dispersion, the nucleator dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent solution, the emulsion for coating solution was added thereto in an amount of 0.22 mol by silver amount per 1 mol of the silver salt of a fatty acid, followed by thorough mixing just prior to the coating, which is fed directly to a coating die.

2) Preparation of Coating Solution for Intermediate Layer

To 1000 g of poly(vinyl alcohol) PVA-205 (manufactured by Kuraray Co., Ltd.), 163 g of the pigment-1 dispersion, 33 g of a 18.5% by weight aqueous solution of blue dye compound (manufactured by Nippon Kayaku Co., Ltd.: Kayafect turquoise RN liquid 150), 27 mL of a 5% by weight aqueous solution of sodium di(2-ethylhexyl)sulfosuccinate, and 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In 800 mL of water were dissolved 100 g of inert gelatin and 10 mg of benzoisothiazolinone, and thereto were added 10 g of a 10% by weight liquid paraffin emulsion, 30 g of a 10% by weight emulsion of dipentaerythritol hexa-isostearate, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl) sulfosuccinate, 4 g of poly(methyl methacrylate) fine particles (mean particle diameter of 0.7 μm, volume weighted mean distribution of 30%), and 21 g of poly(methyl methacrylate) fine particles (mean particle diameter of 3.6 μm, volume weighted mean distribution of 60%), and the obtained mixture was mixed to give a coating solution for the surface protective layer, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

4. Preparations of Photothermographic Material

1) Preparations of Photothermographic Material-11 to -16

Simultaneous overlaying coating by a slide bead coating method was subjected in order of the image forming layer, intermediate layer, first layer of the surface protective layers, and second layer of the surface protective layers, starting from the undercoated face. Thus samples of photothermographic material were produced.

In this method, the temperature of the coating solution was adjusted to 31° C. for the image forming layer and intermediate layer, to 36° C. for the first layer of the surface protective layers, and to 37° C. for the second layer of the surface protective layers. The amount of coated silver was 0.862 g/m$^2$ per one side, with respect to the sum of the silver salt of a fatty acid and silver halide. This was coated on both sides of the support.

The coating amount of each compound (g/m$^2$) for the image forming layer per one side is as follows.

| | |
|---|---|
| Silver salt of a fatty acid | 2.85 |
| Organic polyhalogen compound-1 | 0.028 |
| Organic polyhalogen compound-2 | 0.094 |
| Compound represented by formula (I) | (see Table 3) |
| Silver iodide complex-forming agent | 0.46 |
| SBR latex | 2.08 |
| Isoprene latex | 3.12 |
| Reducing agent-3 | 0.46 |
| Nucleator SH-7 | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.175 |

Conditions for coating and drying were as follows.

The support was decharged by ionic wind. Coating was performed at the speed of 160 m/min. Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared photothermographic material had a level of matting of 550 seconds as Beck's smoothness. In addition, measurement of the pH of the film surface gave the result of 6.0.

TABLE 3

| | Compound of Formula (I) | | | | | | |
|---|---|---|---|---|---|---|---|
| | | Addition Amount | Photographic Properties | | | Image | |
| Sample No. | Compound No. | (mol % vs. silver halide) | Fog | Sensitivity | Gradation (γ) | Storability Δ Fog | Note |
| 11 | — | — | 0.15 | 100 | 3.3 | 0.05 | Comparative |
| 12 | Compound A | $1 \times 10^{-4}$ | 0.09 | 78 | 3.4 | 0.04 | Invention |
| 13 | Compound B | $1 \times 10^{-4}$ | 0.10 | 71 | 3.4 | 0.04 | Invention |
| 14 | Compound C | $1 \times 10^{-4}$ | 0.04 | 82 | 3.5 | 0.03 | Invention |
| 15 | Compound D | $1 \times 10^{-4}$ | 0.02 | 85 | 3.6 | 0.01 | Invention |
| 16 | Compound E | $1 \times 10^{-4}$ | 0.03 | 80 | 3.6 | 0.01 | Invention |

Chemical structures of the compounds used in Examples of the invention are shown below.

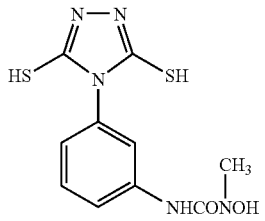

Compound 1 having absorptive group and reducing group

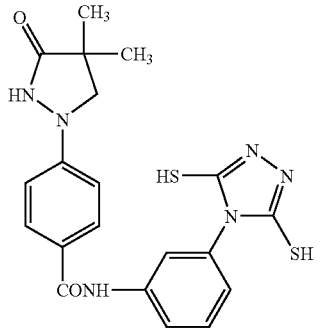

Compound 2 having absorptive group and reducing group

-continued

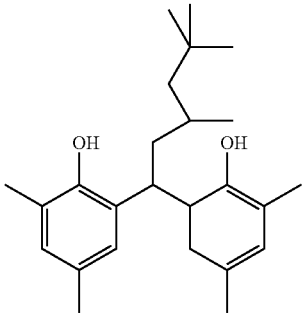

Reducing agent-3

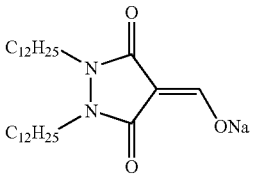

Nucleator SH-7

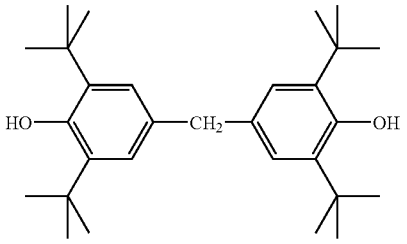

Color-tone-adjusting agent-1

5. Evaluation of Performance

1) Preparation

The obtained sample was cut and wrapped with the packaging material similar to Example 1.

2) Exposure and Thermal Development

Thus prepared double-sided coated photothermographic material was evaluated as follows.

Two sheets of X-ray regular screen HI-SCREEN-B3 ($CaWO_4$ was used as fluorescent substance, the emission peak wavelength of 425 nm) produced by Fuji Photo Film Co., Ltd. were used, and the assembly for image formation was provided by inserting the sample between them.

This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. Changing the exposure value of X-ray by a distance method, the sample was subjected to exposure with a step wedge tablet having a width of 0.15 in terms of log E. After exposure, the exposed sample was subjected to thermal development with the condition mentioned below, and then the obtained image was evaluated by a densitometer.

The thermal developing portion of Fuji Medical Dry Laser Imager FM-DPL was modified so that it can heat from both sides, and by another modification the transportation rollers in the thermal developing portion were changed to the heating drum so that the sheet of film could be conveyed. The temperature of four panel heaters were set to 112° C.-118° C.-120° C.-120° C., and the temperature of the heating drum was set to 120° C. By adjusting the speed of transportation, the total time period for thermal development was set to be 24 seconds.

3) Terms of Evaluation (Photographic Properties)

Densities of the obtained image were measured by using a Macbeth densitometer to draw a photographic characteristic curve representing a relationship between density and the common logarithm of exposure value.

Fog: The density of the non-image part was measured using a Macbeth densitometer.

Sensitivity: Sensitivity is the inverse of the exposure value giving image density of fog+1.0. The sensitivities are shown in a relative value, detecting the sensitivity of Sample No. 11 to be 100. The bigger the value is, it shows that sensitivity is higher.

Gradation (γ): Gradation is gradient of a straight line connecting the points at fog+(density of 1.2) and fog+(density of 1.6) on the photographic characteristic curve.

(Image Storability)

Image samples obtained by thermally developing the samples were left for 200 days under an illumination condition of fluorescent lamp of 500 Lux at 25° C. and 60RH %. Image storability is evaluated by the difference in fog (Δ fog) between the fog just after thermal development and the fog after leaving. The smaller is the increase in fog, the more preferable it is.

Δ Fog=Fog (after leaving)−Fog (just after thermal development)

The obtained results are shown in Table 3.

4) Results

As shown in Table 3, the compounds of the present invention depress the increase of fog during image storage as well as the fog immediately after thermal development. Among them, compound D and compound E, which are represented by formula (III), exhibit excellent improved results. Particularly, compound D exhibits remarkable improved results.

Example 4

1. Preparation of Silver Halide Emulsion E

<Preparation of Tabular AgI Emulsion Subjected to Gold Sensitization>

A silver halide emulsion before being subjected to chemical sensitization was prepared similar to Example 3. The silver halide emulsion was kept at 45° C. with stirring, and thereto were added sodium benzene thiosulfonate in a methanol solution at $3.0\times10^{-5}$ mol per 1 mol of silver and the sulfur sensitizer, 4-oxo-3-benzyl-oxazolidine-2-thione, in a methanol solution at $4.5\times10^{-5}$ mol per 1 mol of silver. At additional 5 minutes later, chloroauric acid in an aqueous solution at $1.2\times10^{-5}$ mol per 1 mol of silver and potassium thiocyanate in an aqueous solution at $5.0\times10^{-3}$ mol per 1 mol of silver were added and subjected to ripening for 60 minutes.

Then, 0.7 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-4}$ mol per 1 mol of silver, 1-phenyl-2-heptyl-5-mercapto-1,3,4-triazole in a methanol solution at $5.4\times10^{-4}$ mol per 1 mol of silver, and 1-(3-methylureido phenyl)-5-mercaptotetrazole in an aqueous solution at $8.5\times10^{-4}$ mol per 1 mol of silver were added.

Silver halide emulsion 4 was prepared similar to Example 3 except that changing the chemical sensitization as described above.

2. Preparations of Coated Sample

Sample Nos. 21 to 26 were prepared similar to Example 3 except that the silver halide emulsion E was used instead of the silver halide emulsion D.

TABLE 4

| Sample No. | Compound of Formula (I) Compound No. | Addition Amount (mol % vs. silver halide) | Photographic Properties Fog | Sensitivity | Gradation (γ) | Image Storability Δ Fog | Note |
|---|---|---|---|---|---|---|---|
| 21 | — | — | 0.24 | 100 | 2.6 | 0.07 | Comparative |
| 22 | Compound A | $1 \times 10^{-4}$ | 0.18 | 74 | 2.8 | 0.05 | Invention |
| 23 | Compound B | $1 \times 10^{-4}$ | 0.2 | 72 | 2.6 | 0.04 | Invention |
| 24 | Compound C | $1 \times 10^{-4}$ | 0.14 | 80 | 3.2 | 0.03 | Invention |
| 25 | Compound D | $1 \times 10^{-4}$ | 0.03 | 85 | 3.6 | 0.01 | Invention |
| 26 | Compound E | $1 \times 10^{-4}$ | 0.05 | 85 | 3.4 | 0.02 | Invention |

3. Evaluation of Performance

Evaluation was performed similar to Example 3. The obtained results are shown in Table 4.

In case of the gold-sulfur (gold plus sulfur) sensitized emulsion, the increase of fog during image storage as well as the fog immediately after thermal development is depressed. Especially, the samples containing compound D and E represented by formula (III) exhibit excellent improved results. In particular, it is the same as in Example 1 that the sample containing compound D can exhibit remarkable improved results. Moreover, the gold-sulfur sensitized emulsion brings about softening the gradation. However, it is found that the emulsion containing the compounds used for the present invention can give the unexpected results to make the gradation hard, compared with the emulsion where the compound is not included.

Example 5

Experiment was performed similar to Example 4, except that the following fluorescent intensifying screen A was used instead of X-ray regular screen HI-SCREEN-B3 in Example 4.

As a result, the photothermographic materials of the present invention exhibit excellent results similar to Example 4.

<Preparation of Fluorescent Intensifying Screen A>

(1) Undercoating

A light reflecting layer comprising alumina powder was coated on a polyethylene terephthalate film (support) having a thickness of 250 μm in a similar manner to the Example 4 in JP-A. No. 2001-124898. The light reflecting layer, which had a film thickness of 50 μm after drying, was prepared.

(2) Preparation of Fluorescent Substance Sheet 250 g of BaFBr:Eu fluorescent substance (mean particle size of 3.5 μm), 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 101) and 0.5 g of isocyanate compounds (manufactured by Nippon Polyurethane Industry Co., Ltd., trade name: CORONATE HX) were added into methyl ethyl ketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

(3) Overlaying the Fluorescent Substance Sheet on Light Reflective Layer.

The fluorescent substance sheet prepared above was overlaid on the surface of the light reflective layer of the support having a light reflective layer made in the above process (1), and then pressed by a calendar roller at the pressure of 400 kgw/cm$^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

(4) Preparation of Surface Protective Layer

Polyester type adhesive agents were coated on one side of a polyethylene terephthalate (PET) film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

(5) Emission Characteristics

The emission spectrum of the intensifying screen A was measured by X-ray at 40 kVp and is shown in FIG. 2. The fluorescent intensifying screen A showed an emission having a peak at 390 nm and a narrow half band width.

What is claimed is:

1. An image forming method using a photothermographic material comprising, on at least one side of a support, an image forming layer comprising at least a photosensitive silver halide, a non-photosensitive silver salt of a fatty acid, a reducing agent, and a binder, wherein the photothermographic material comprises an acetylene compound represented by the following formula (II) or a salt thereof:

Formula (II)

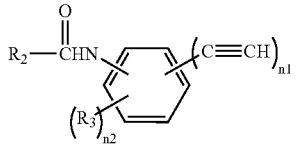

wherein $R_2$ represents a substituted or unsubstituted alkyl group, aryl group, or heterocyclic group; $R_3$ represents a hydrogen atom or a substituent substituting for a hydrogen atom on a benzene ring; n1 represents an integer of 1; and n2 represents an integer of from 0 to 4;

wherein the image forming method comprises:

1) imagewise exposing the photothermographic material with lights to record a latent image on the photothermographic material; and 2) thermally developing the photothermographic material at a temperature of 107° C. to 140° C. to convert the latent image into a visible image by thermal development.

2. The image forming method according to claim 1, wherein the compound represented by formula (II) or a salt thereof is a compound represented by the following formula (III) or a salt thereof:

Formula (III)

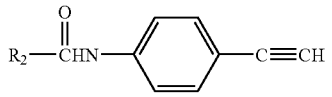

wherein $R_2$ has the same meaning as in formula (II).

3. The image forming method according to claim 1, wherein a mean grain size of the photosensitive silver halide is from 0.01 μm to 0.20 μm.

4. The image forming method according to claim 3, wherein the binder is formed by a polymer latex.

5. The image forming method according to claim 3, wherein the photosensitive silver halide is subjected to gold sensitization.

6. The image forming method according to claim 4, wherein the polymer latex contains a monomer component represented by the following formula (M) in a range of from 10% by weight to 70% by weight:

$$CH_2{=}CR^{01}{-}CR^{02}{=}CH_2$$ Formula (M)

wherein $R^{01}$ and $R^{02}$ each independently represent one selected from the group consisting of a hydrogen atom, an alkyl group having from 1 to 6 carbon atoms, a halogen atom, and a cyano group.

7. The image forming method according to claim 6, wherein, in formula (M), both of $R^{01}$ and $R^{02}$ represent a hydrogen atom, or one of $R^{01}$ or $R^{02}$ represents a hydrogen atom and the other represents a methyl group.

8. The image forming method according to claim 1, wherein the photothermographic material further comprises at least one development accelerator represented by the following formulae (A-1) or (A-2):

$$Q_1\text{-NHNH-}Q_2$$ Formula (A-1)

wherein $Q_1$ represents an aromatic group or a heterocyclic group which bonds to —NHNH-$Q_2$ at a carbon atom; and $Q_2$ represents one selected from a carbamoyl group, an acyl group, an alkoxycarbonyl group, an aryloxycarbonyl group, a sulfonyl group, or a sulfamoyl group; and Formula (A-2)

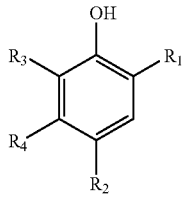

wherein $R_1$ represents one selected from an alkyl group, an acyl group, an acylamino group, a sulfonamide group, an alkoxycarbonyl group, or a carbamoyl group; $R_2$ represents one selected from a hydrogen atom, a halogen atom, an alkyl group, an alkoxy group, an aryloxy group, an alkylthio group, an arylthio group, an acyloxy group, or a carbonic acid ester group; $R_3$ and $R_4$ each independently represent a hydrogen atom or a group substituting for a hydrogen atom on a benzene ring; and $R_3$ and $R_4$ may bond to each other to form a condensed ring.

9. The image forming method according to claim 1, wherein the photosensitive silver halide has an average silver iodide content of 40 mol % or higher.

10. The image forming method according to claim 9, wherein the compound represented by formula (II) or a salt thereof is a compound represented by the following formula (III) or a salt thereof:

Formula (III)

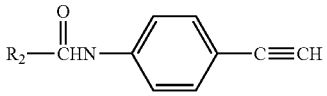

wherein $R_2$ has the same meaning as in formula (II).

11. The image forming method according to claim 9, wherein 50% or more of a total projected area of the photosensitive silver halide is occupied by tabular grains having an aspect ratio of 2 or more.

12. The image forming method according to claim 11, wherein a mean equivalent circular diameter of the tabular grains is from 0.3 μm to 5.0 μm.

13. The image forming method according to claim 11, wherein the aspect ratio of the tabular grains is from 5 to 100.

14. The image forming method according to claim 9, wherein the average silver iodide content of the photosensitive silver halide is 80 mol % or higher.

15. The image forming method according to claim 9, wherein the photosensitive silver halide is subjected to gold sensitization.

16. The image forming method according to claim 9, wherein the photothermographic material further comprises a silver iodide complex-forming agent.

17. The image forming method according to claim 9, wherein the photothermographic material further comprises at least one development accelerator represented by the following formulae (A-1) or (A-2):

$$Q_1\text{-NHNH-}Q_2$$ Formula (A-1)

wherein $Q_1$ represents an aromatic group or a heterocyclic group which bonds to —NHNH-$Q_2$ at a carbon atom; and $Q_2$ represents one selected from a carbamoyl group, an acyl group, an alkoxycarbonyl group, an aryloxycarbonyl group, a sulfonyl group, or a sulfamoyl group; and Formula (A-2)

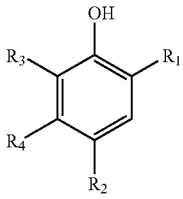

wherein $R_1$ represents one selected from an alkyl group, an acyl group, an acylamino group, a sulfonamide group, an alkoxycarbonyl group, or a carbamoyl group; $R_2$ represents one selected from a hydrogen atom, a halogen atom, an alkyl group, an alkoxy group, an aryloxy group, an alkylthio group, an arylthio group, an acyloxy group, or a carbonic acid ester group; $R_3$ and $R_4$ each independently represent a hydrogen atom or a group substituting for a hydrogen atom on a benzene ring; and $R_3$ and $R_4$ may bond to each other to form a condensed ring.

18. The image forming method according to claim 9, wherein the photothermographic material comprises the image forming layer on both sides of the support.

19. The image forming method according to claim 1, wherein the image forming layer is prepared by:

preparing the photosensitive silver halide containing the compound represented by formula (II);

preparing a coating solution for the image forming layer by adding the photosensitive silver halide and at least the non-photosensitive silver salt of a fatty acid, the reducing agent, and the binder;

and coating the coating solution.

20. An image forming method, which is an X-ray image forming method using a photothermographic material comprising, on at least one side of a support, an image forming layer comprising at least a photosensitive silver halide, a non-photosensitive silver salt of a fatty acid, a reducing agent, and a binder, wherein the photosensitive silver halide has an average silver iodide content of 40 mol % or higher, and the photothermographic material comprises an acetylene compound represented by the following formula (II) or a salt thereof:

Formula (II)

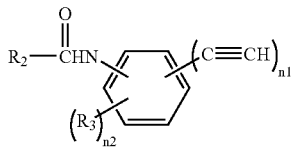

wherein $R_2$ represents a substituted or unsubstituted alkyl group, aryl group, or heterocyclic group; $R_3$ represents a hydrogen atom or a substituent substituting for a hydrogen atom on a benzene ring; n1 represents an integer of 1; and n2 represents an integer of from 0 to 4;

wherein the image forming method comprises:

1) bringing the photothermographic material into contact with a fluorescent intensifying screen;

2) imagewise exposing the photothermographic material with X-rays to record a latent image on the photothermographic material; and 3) thermally developing the photothermographic material at a temperature of 107° C. to 140° C. to convert the latent image into a visible image by thermal development.

* * * * *